US005478417A

United States Patent [19]

Heck et al.

[11] Patent Number: 5,478,417

[45] Date of Patent: Dec. 26, 1995

[54] CONTROLLED THERMAL EXPANSION SUPERALLOY

[75] Inventors: Karl A. Heck, Proctorville; Melissa A. Moore, South Point, both of Ohio; Darrell F. Smith, Jr.; Larry I. Stein, both of Huntington, W. Va.; John S. Smith, Proctorville, Ohio

[73] Assignee: Goro Nickel S.A., Caledonie

[21] Appl. No.: 344,349

[22] Filed: Nov. 22, 1994

Related U.S. Application Data

[60] Division of Ser. No. 116,651, Sep. 3, 1993, Pat. No. 5,439,640, which is a continuation-in-part of Ser. No. 947,262, Sep. 18, 1992, abandoned.

[51] Int. Cl.[6] ..... C22C 38/00

[52] U.S. Cl. ..... 148/328; 148/442; 420/586

[58] Field of Search ..... 148/501, 585, 148/442, 328; 420/586, 95

[56] References Cited

U.S. PATENT DOCUMENTS

| | | | |
|---|---|---|---|
| 4,685,978 | 8/1987 | Smith et al. | 148/501 |
| 4,908,069 | 3/1990 | Doherty et al. | 148/501 |
| 5,169,463 | 12/1992 | Doherty et al. | 148/501 |
| 5,283,032 | 2/1994 | Wanner et al. | 420/586 |

*Primary Examiner*—Scott Kastler

*Attorney, Agent, or Firm*—Blake T. Biederman; Edward A. Steen

[57] ABSTRACT

The invention provides a controlled coefficient of thermal expansion alloy having in weight percent about 26–50% cobalt, about 20–40% nickel, about 20–35% iron, about 4–10% aluminum, about 0.5–5% niobium plus ½ of tantalum weight percent and about 1.5–10% chromium. Additionally the alloy may contain about 0–1% titanium, about 0–0.2% carbon, about 0–1% copper, about 0–2% manganese, about 0–2% silicon, about 0–8% molybdenum, about 0–8% tungsten, about 0–0.3% boron, about 0–2% rhenium, about 0–2% hafnium, about 0–0.3% zirconium, about 0–0.5% nitrogen, about 0–1% yttrium, about 0–1% lanthanum, about 0–1% total rare earths other than lanthanum, about 0–1% cerium, about 0–1% magnesium, about 0–1% calcium, about 0–4% oxidic dispersoid and incidental impurities. The alloy may be further optimized with respect to crack growth resistance by annealing at temperature below about 1010° C. or temperatures between 1066° C. or 1110° C. and the melting temperature and by aging at a beta precipitation temperature greater than about 788° C.

22 Claims, 10 Drawing Sheets

STATIC CRACK GROWTH RATE (mm/S)

da/dt ≦ 5 x 10$^{-5}$ (mm/S)

da/dt ≦ 2 x 10$^{-5}$ (mm/S)

CONTROLLED THERMAL EXPANSION SUPERALLOY

This is a divisional of application U.S. Ser. No. 08/116,651, filed Sep. 3, 1993, now U.S. Pat. No. 5,439,640. U.S. Ser. No. 08/116,651 was a continuation-in-part application of U.S. Ser. No. 07/947,262, filed Sep. 18, 1992, now abandoned.

FIELD OF INVENTION

This invention is related to the field of controlled thermal expansion alloys. In particular, this invention is related to the field of three-phase gamma, gamma prime, beta superalloys having relatively low coefficients of thermal expansion.

BACKGROUND OF THE INVENTION AND PROBLEM

A novel three-phase low coefficient of thermal expansion alloy is described in EPO Patent Publication No. 433,072 ('072) published Jun. 19, 1991. The disclosure of the '072 publication provided improved resistance to stress accelerated grain boundary oxygen embrittlement (SAGBO) in combination with a controlled relatively low coefficient of thermal expansion. The alloy of the '072 patent publication also provided excellent notch rupture strength, relatively low density and acceptable impact strength. Specific applications of the '072 alloy include critical structural turbine engine components such as seals, rings, discs, compressor blades and casings. Low coefficient of thermal expansion alloys are often designated for applications that include structural components having close tolerances that must not catastrophically fail.

In the past, turbine engine manufacturers have only required that alloys be notch ductile for use in critical structural applications. Recently, turbine engine manufacturers have been requiring that alloys also be crack growth resistant. INCONEL® alloy 718 (Registered trademark of alloy produced by Inco Alloys International, Inc.) is an example of a turbine alloy with excellent crack growth resistance. Crack growth resistance allows an alloy to be forgiving of defects, voids and cracks. Furthermore, crack growth resistance facilitates predictability of part life and location of cracks by inspection prior to failure. Unfortunately, low coefficient of thermal expansion superalloys used in combination with alloy 718 have historically suffered from crack growth problems at temperatures of 538° C. (1000° F.). Although the '072 alloy provides excellent notch ductile behavior and excellent resistance to crack initiation, it is highly desirable for an '072 type alloy to have improved crack growth resistance.

INCOLOY® alloy 909 (Registered trademark of alloy produced by Inco Alloys International, Inc.) is being used in structural applications requiring a relatively low coefficient of thermal expansion. A relatively low coefficient of thermal expansion (CTE) is defined for purposes of this specification as being an alloy providing at least a 10% lower CTE than alloy 718. However, although alloy 909 provides a relatively low coefficient of thermal expansion, alloy 909 does not offer the crack growth resistance of alloy 718. Furthermore, alloy 909 suffers from extensive oxidation problem at elevated temperatures. Turbine engine components fabricated of alloy 909 and other 900 series alloys must be periodically replaced during scheduled engine maintenance. The replacement of components fabricated out of alloy 909 contributes significantly to the overall cost of maintaining turbine engines. An alloy having relatively low thermal expansion properties in combination with oxidation resistance would facilitate reduction of engine maintenance costs.

It is the object of this invention to provide an alloy with improved crack growth resistance in combination with the properties of SAGBO resistance, controlled coefficient of thermal expansion, notch rupture strength, impact strength, and reduced density.

It is a further object of this invention to provide an alloy that has relatively low thermal expansion in combination with improved oxidation resistance and stability.

SUMMARY OF THE INVENTION

The invention provides a controlled coefficient of thermal expansion alloy having in weight percent about 26–50% cobalt, about 20–40% nickel, about 20–35% iron, about 4–10% aluminum, about 0.5–5% niobium plus ½ of tantalum weight percent and about 1.5–10% chromium. Additionally the alloy may contain about 0–1% titanium, about 0–0.2% carbon, about 0–1% copper, about 0–2% manganese, about 0–2% silicon, about 0– 8% molybdenum, about 0–8% tungsten, about 0–0.3% boron, about 0–2% hafnium, about 0–2% rhenium, about 0–0.3% zirconium, about 0–0.5% nitrogen, about 0–1% yttrium, about 0–1% lanthanum, about 0–1% total rare earths other than lanthanum, about 0–1% cerium, about 0–1% magnesium, about 0–1% calcium, about 0–4% oxidic dispersoid and incidental impurities. The alloy may be further optimized with respect to crack growth resistance by annealing at temperatures below about 1010° C. or temperatures between 1066° C. or 1110° C. and the melting temperature and by aging at a beta precipitation temperature greater than about 788° C.

DESCRIPTION OF PREFERRED EMBODIMENT

Figure 1:
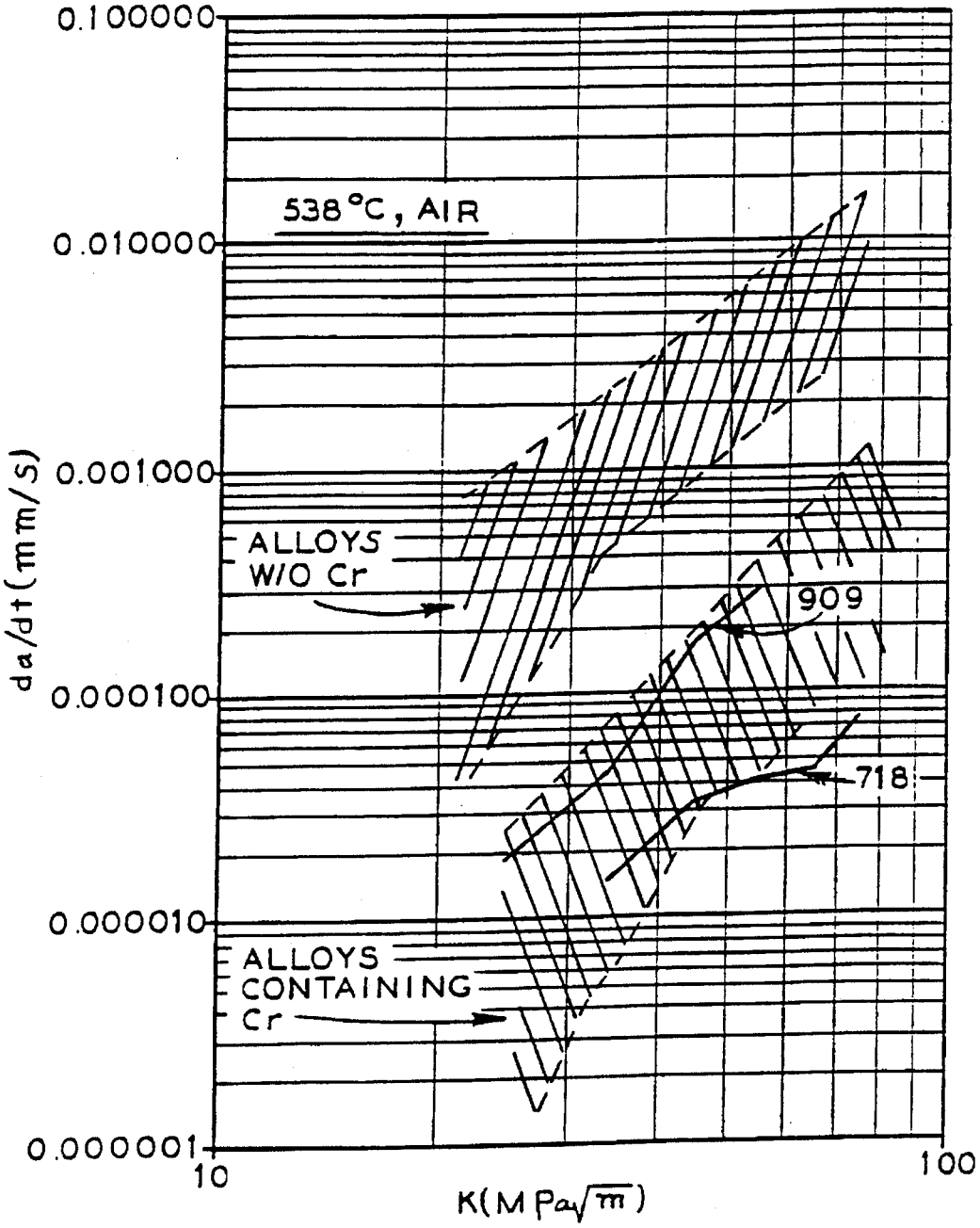
FIG. 1 is a plot of static crack growth at 538° C. as measured in a transverse-longitudinal direction comparing various compositions.

It has been discovered that a small amount of chromium in combination with increased cobalt concentration provides an unexpected decrease in crack propagation rate. Furthermore, a four step heat treatment comprising of an anneal, a beta age and two gamma prime aging steps may be used when chromium is present to optimize crack growth and yield strength. In addition, the alloy provides at least a 10% decrease in CTE over its useful operating temperature range in comparison to Alloy 718.

Cobalt in an amount of 26%–50% has been found to increase crack growth resistance at temperatures of about 538° C. (All compositions expressed in this application are provided in weight percent, unless specifically stated otherwise). Cobalt in excess of 50% is believed to lower rupture strength. Nickel in an amount of 20–40% stabilizes the austenitic phase. Furthermore, nickel promotes room temperature ductility of the alloy. Iron in an amount of 20–35% provides a lower coefficient of thermal expansion and lowers the inflection temperature when substituted for cobalt or nickel. Excess iron causes instability of the alloy.

Aluminum promotes formation of a beta phase. For purposes of this application, beta phase includes an Al-rich phase capable of ordering and transforming into intermetallic structures based upon Al-lean FeAl, CoAl and NiAl. The beta phase may be disordered at room or high temperature. Order of beta phase cooled to room temperature may differ from beta ordering that occurs during high temperature service. The beta phase contributes to providing stress accelerated grain boundary oxidation (SAGBO) resistance. Furthermore, beta phase has been found to contribute to hot workability of the alloy. In addition, aluminum promotes formation of gamma prime phase which increases strength. Morphologies of the beta and gamma prime phases are believed to partially control crack growth rates at 538° C. Finally, aluminum decreases density of the alloy and dramatically improves general surface oxidation resistance.

Chromium in a relatively small amount of 1.5 to 10% increases crack growth resistance in combination with high cobalt at high temperature. Chromium has also been found to improve response to heat treatment and increase stress rupture strength. Advantageously, 1.5–5% chromium is used to provide only a slight increase in CTE above the inflection temperature and to only slightly lower the inflection temperature. Furthermore, chromium improves creep resistance of the alloy.

Niobium in an mount of 0.5–5% has been found to increase high temperature stress rupture and tensile strength at high temperature. In addition, niobium stabilizes the morphology of the alloy and may strengthen the beta phase.

An amount up to 1% titanium promotes strength of the alloy. However, excess titanium promotes phase instability. Carbon may be added in an amount up to 0.2%. Increased carbon slightly reduces stress rupture strength.

Copper may be present in an amount up to 1% and manganese may be present in an amount up to 2%. Silicon is advantageously maintained below 2%. Silicon has been found to decrease stress rupture strength when present in an amount greater than 0.25%. Molybdenum, in an amount up to 8%, benefits strength and increases corrosion resistance. However, molybdenum adversely increases density and coefficient of thermal expansion. Tungsten in an amount up to 8% has been found to benefit stress rupture strength at the expense of density and coefficient of thermal expansion.

Boron may be present in an amount up to 0.3%. Excess boron causes hot malleability and weldability problems. Hafnium and rhenium each may be present in an amount up to 2%. Zirconium may be present in an amount up to 0.3%. Zirconium can adversely affect hot malleability. Yttrium, lanthanum and cerium may each be present in an amount up to 1%. Similarly other rare earths may be present in amounts up to 1%. Yttrium, lanthanum, cerium and rare earths would be predicted to increase oxidation resistance. Magnesium, calcium and other deoxidizers and malleablizers may be used in amounts up to 1%. Alternatively, oxidic dispersoids such as yttria, alumina and zirconia in amounts up to 4% may be used. Advantageously, oxidic dispersoids are added by mechanical alloying.

Table 1 below discloses contemplated compositions of the present invention. Table 1 is intended to disclose all ranges between any two of the specified values. For example, an alloy may contain about 28–40% Co, 25–30% Ni, 4.5–6% Al, 0.75–3.5% Nb and 1.5–5% Cr.

TABLE 1

| | | | | | | |
|---|---|---|---|---|---|---|
| Co | 26 | 28 | 30 | 40 | 45 | 50 |
| Ni | 20 | 25 | 26 | 30 | 35 | 40 |
| Fe | 20 | 22 | 24 | 28 | 30 | 35 |
| Al | 4 | 5 | 7 | 7.5 | 8 | 10 |
| Nb + ½ Ta | 0.5 | 0.75 | 1 | 3.5 | 5 | 7.5 |
| Cr | 1.5 | 2 | 4 | 5 | 8 | 10 |
| Ti | 0 | 0.2 | 0.4 | 0.6 | 0.9 | 1 |
| C | 0 | 0.025 | 0.05 | 0.08 | 0.10 | 0.2 |
| Cu | 0 | 0.2 | 0.4 | 0.6 | 0.8 | 1 |
| Mn | 0 | 0.25 | 0.5 | 1 | 1.5 | 2 |
| Si | 0 | 0.25 | 0.5 | 1 | 1.5 | 2 |
| Mo | 0 | 1 | 2 | 3 | 5 | 8 |
| W | 0 | 1 | 2 | 3 | 5 | 8 |
| B | 0 | 0.005 | 0.015 | 0.25 | 0.1 | 0.3 |
| Hf | 0 | 0.25 | 0.5 | 1 | 1.5 | 2 |
| Re | 0 | 0.25 | 0.5 | 1 | 1.5 | 2 |
| Zr | 0 | 0.05 | 0.1 | 0.2 | 0.25 | 0.3 |
| N | 0 | 0.05 | 0.1 | 0.2 | 0.3 | 0.5 |
| Y | 0 | 0.2 | 0.4 | 0.6 | 0.8 | 1 |
| La | 0 | 0.2 | 0.4 | 0.6 | 0.8 | 1 |
| Rare Earths | 0 | 0.2 | 0.4 | 0.6 | 0.8 | 1 |
| Ce | 0 | 0.2 | 0.4 | 0.6 | 0.8 | 1 |
| Mg | 0 | 0.2 | 0.4 | 0.6 | 0.8 | 1 |

TABLE 1-continued

| | | | | | | |
|---|---|---|---|---|---|---|
| Ca | 0 | 0.2 | 0.4 | 0.6 | 0.8 | 1 |
| Oxidic Dispersoid | 0 | 1 | 2 | 2.5 | 3 | 4 |

Table 2 below discloses the advantageous ranges of the invention believed to provide excellent crack growth resistance at 538° C.

TABLE 2

| | Broad | Intermediate | Narrow |
|---|---|---|---|
| Co | 26–50 | 28–45 | 30–38 |
| Ni | 20–40 | 25–35 | 26–33 |
| Fe | 20–35 | 22–30 | 24–28 |

TABLE 2-continued

| | Broad | Intermediate | Narrow |
|---|---|---|---|
| Al | 4–10 | 4–9 | 4.8–6.0 |
| Nb + ½ Ta | 0.5–5 | 1–4 | 2–3.5 |
| Cr | 1.5–10 | 1.5–5 | 2–4 |
| Ti | 0–1 | 0–0.5 | 0–0.2 |
| C | 0–0.2 | 0–0.1 | 0–0.05 |
| Cu | 0–1 | 0–0.75[a] | 0–0.5[c] |
| Mn | 0–2 | 0–1[a] | 0–0.5[c] |
| Si | 0–2 | 0–1[a] | 0–0.5[c] |
| Mo | 0–8 | 0–5[b] | 0–3[b] |
| W | 0–8 | 0–5[b] | 0–3[b] |
| B | 0–0.3 | 0–0.05 | 0–0.015 |
| Hf | 0–2 | 0–1 | 0–0.5 |
| Re | 0–2 | 0–1 | 0–0.5 |
| Zr | 0–0.3 | 0–0.2 | 0–0.1 |
| N | 0–0.5 | 0–0.3 | 0–0.2 |
| Y | 0–1 | 0–0.5 | 0–0.2 |
| La | 0–1 | 0–0.5 | 0–0.2 |
| Rare Earths | 0–1 | 0–0.5 | 0–0.2 |
| Ce | 0–1 | 0–0.5 | 0.2 |
| Mg | 0–1 | 0–0.5 | 0.2 |
| Ca | 0–1 | 0–0.5 | 0.2 |
| Oxidic Dispersoid | 0–4 | 0–3 | 0–2 |

[a]Cu + Mn + Si ≦ 1.5
[b]Mo + W ≦ 5
[c]Cu + Mn + Si ≦ 1

Table 3 attached contains a listing of compositions tested for alloys of the invention.

Table 4 below contains a key of heat numbers indexed to the compositions of Table 3. All compositions contained in this specification are expressed in weight percent, unless specifically indicated. Table 4 illustrates heats having varied amounts of nickel, cobalt, chromium and niobium with iron maintained at 27.5% and aluminum maintained at 5.4%.

TABLE 3

| Heat | C | Mn | Fe | Si | Cu | Ni | Cr | Al | Ti | Co | Nb | B |
|---|---|---|---|---|---|---|---|---|---|---|---|---|
| 1 | 0.004 | 0.01 | 27.1 | 0.02 | 0.01 | 33.1 | 0.02 | 5.3 | 0.63 | 30.8 | 3.0 | .006 |
| 2 | 0.015 | 0.09 | 26.4 | 0.06 | 0.01 | 34.1 | 1.06 | 5.3 | <0.01 | 30.3 | 3.1 | .007 |
| 3 | 0.008 | 0.10 | 24.5 | 0.07 | 0.01 | 34.0 | 3.06 | 5.4 | <0.01 | 30.3 | 3.0 | .008 |
| 4 | 0.007 | 0.09 | 27.6 | 0.10 | 0.01 | 29.9 | 0.00 | 5.5 | 0.14 | 34.1 | 3.1 | .006 |
| 5 | 0.006 | 0.09 | 27.7 | 0.09 | 0.01 | 30.0 | 2.00 | 5.4 | 0.14 | 34.1 | 3.1 | .006 |
| 6 | 0.007 | 0.08 | 27.7 | 0.08 | 0.02 | 30.0 | 3.00 | 5.4 | 0.14 | 31.0 | 3.1 | .006 |
| 7 | 0.007 | 0.09 | 27.7 | 0.09 | 0.01 | 30.0 | 0.03 | 5.5 | 0.14 | 31.0 | 4.1 | .006 |
| 8 | 0.020 | 0.09 | 27.8 | 0.09 | 0.02 | 30.0 | 2.01 | 5.5 | 0.14 | 31.0 | 4.1 | .006 |
| 9 | 0.007 | 0.08 | 27.7 | 0.09 | 0.01 | 30.0 | 3.03 | 5.5 | 0.14 | 29.9 | 4.1 | .006 |
| 10 | 0.017 | 0.09 | 27.7 | 0.11 | 0.01 | 32.9 | 0.07 | 5.4 | 0.13 | 31.0 | 3.1 | .007 |
| 11 | 0.009 | 0.09 | 27.7 | 0.10 | 0.01 | 32.9 | 2.01 | 5.5 | 0.14 | 28.9 | 3.1 | .006 |
| 12 | 0.017 | 0.08 | 27.7 | 0.08 | 0.02 | 33.0 | 3.02 | 5.4 | 0.14 | 27.9 | 3.1 | .006 |
| 13 | 0.011 | 0.09 | 27.6 | 0.09 | 0.02 | 32.9 | 0.05 | 5.5 | 0.14 | 29.9 | 4.1 | .006 |
| 14 | 0.009 | 0.09 | 27.8 | 0.11 | 0.02 | 33.0 | 1.93 | 5.4 | 0.13 | 28.0 | 4.2 | .006 |
| 15 | 0.014 | 0.09 | 27.7 | 0.10 | 0.02 | 32.9 | 3.01 | 5.4 | 0.13 | 26.8 | 4.1 | .006 |
| 16 | 0.005 | <0.01 | 27.7 | 0.12 | 0.01 | 27.4 | 2.90 | 5.4 | 0.23 | 33.9 | 3.0 | .008 |
| 17 | 0.011 | <0.01 | 27.7 | 0.12 | 0.01 | 27.0 | 3.05 | 5.4 | 0.13 | 33.1 | 4.1 | .008 |
| 18 | 0.013 | <0.01 | 27.6 | 0.11 | 0.01 | 27.0 | 3.51 | 5.4 | 0.11 | 33.7 | 3.2 | .007 |
| 19 | 0.006 | <0.01 | 27.6 | 0.11 | 0.01 | 27.0 | 3.53 | 5.4 | 0.10 | 32.6 | 4.1 | .009 |
| 20 | 0.008 | <0.01 | 27.7 | 0.10 | 0.02 | 27.0 | 4.04 | 5.4 | 0.10 | 33.1 | 3.1 | .009 |
| 21 | 0.006 | <0.01 | 27.7 | 0.12 | 0.02 | 27.0 | 4.07 | 5.4 | 0.10 | 32.1 | 4.1 | .009 |
| 22 | 0.016 | <0.01 | 27.7 | 0.10 | 0.02 | 30.0 | 3.55 | 5.3 | 0.09 | 30.6 | 3.1 | .009 |
| 23 | 0.011 | <0.01 | 27.8 | 0.09 | 0.02 | 29.9 | 3.55 | 5.4 | 0.09 | 29.6 | 4.0 | .009 |
| 24 | 0.015 | <0.01 | 27.7 | 0.11 | 0.02 | 30.0 | 4.02 | 5.3 | 0.10 | 30.1 | 3.1 | .009 |
| 25 | 0.015 | <0.01 | 27.6 | 0.11 | 0.01 | 30.1 | 3.99 | 5.5 | 0.10 | 29.0 | 4.2 | .008 |
| 26 | 0.012 | <0.01 | 27.6 | 0.11 | 0.01 | 33.0 | 3.51 | 5.4 | 0.09 | 27.5 | 3.2 | .009 |
| 27 | 0.012 | <0.01 | 27.7 | 0.10 | 0.01 | 33.1 | 3.53 | 5.4 | 0.09 | 26.5 | 4.1 | .008 |
| 28 | 0.007 | <0.01 | 27.7 | 0.10 | 0.02 | 33.0 | 4.00 | 5.4 | 0.09 | 27.0 | 3.1 | .008 |
| 29 | 0.008 | <0.01 | 27.7 | 0.11 | 0.02 | 33.0 | 4.00 | 5.4 | 0.10 | 26.0 | 4.1 | .009 |
| 30 | <0.01 | 0.01 | 25.85 | 0.03 | 0.07 | 28.63 | 3.03 | 5.39 | 0.01 | 33.91 | 2.95 | .004 |

TABLE 4

EFFECT OF Cr—Nb—Ni ON PROPERTIES - MELT KEY
Base Composition: 27.5 Fe—5.4Al—0.1Ti—Bal. Co
Heat Treatment: 1010° C./1 h, AC + 788° C./16 h FC to 621° C./8 h, AC

| | 27 Ni | | 30 Ni | | 33 Ni | |
|---|---|---|---|---|---|---|
| Cr | 3 Nb | 4 Nb | 3 Nb | 4 Nb | 3 Nb | 4 Nb |
| 0 | — | — | 4 | 7 | 10 | 13 |
| 2 | — | — | 5 | 8 | 11 | 14 |
| 3 | 16 | 17 | 6 | 9 | 12 | 15 |
| 3.5 | 18 | 19 | 22 | 23 | 26 | 27 |
| 4 | 20 | 21 | 24 | 25 | 28 | 29 |

AC = Air cooled
FC = Furnace cooled

Table 5 below provides room temperature mechanical properties of several alloys contained in Table 4.

TABLE 5

EFFECT OF Cr—Nb—Ni ON ROOM TEMPERATURE TENSILE PROPERTIES
Base Composition: 27.5Fe—5.4Al—0.1Ti—Bal. Co
Heat Treatment: 1010° C./1 h, AC + 788° C./16 h FC to 621° C./8 h, AC
0.2% Yield Strength (MPa)/Tensile Strength (MPa)/Elongation %/Reduction of Area %

| | 27 Ni | | 30 Ni | | 33 Ni | |
|---|---|---|---|---|---|---|
| Cr | 3 Nb | 4 Nb | 3 Nb | 4 Nb | 3 Nb | 4 Nb |
| 0 | — | — | 958 | 1041 | 993 | 1075 |
| | | | 1330 | 1406 | 1344 | 1406 |
| | | | 16/35 | 11/24 | 14/30 | 13/19 |
| 2 | — | — | 958 | 1007 | 965 | 1069 |
| | | | 1351 | 1379 | 1338 | 1420 |
| | | | 16/27 | 13/22 | 18/38 | 12/23 |
| 3 | 910 | 938 | 938 | 1007 | 958 | 1027 |
| | 1317 | 1324 | 1338 | 1406 | 1358 | 1406 |
| | 16/23 | 7/7 | 18/33 | 13/18 | 19/39 | 11/19 |
| 3.5 | 882 | 931 | 924 | 986 | 972 | 1041 |
| | 1303 | 1220 | 1331 | 1393 | 1365 | 1420 |
| | 16/23 | 4/5 | 17/30 | 11/17 | 17/32 | 12/17 |
| 4 | 876 | 917 | 931 | 986 | 972 | 1034 |
| | 1303 | 1296 | 1338 | 1358 | 1317 | 1427 |
| | 11/11 | 7/8 | 14/20 | 7/7 | 15126 | 13/14 |

Table 5 illustrates that adequate strength and ductilities of all materials containing 3% niobium were satisfactory for gas turbine engine usage. Typical minimum requirements for room temperature strength are 690 MPa (100 ksi) 0.2% yield strength and minimum requirements for room temperature ductility are 10% elongation. Most advantageously, 0.2% yield strength at room temperature is at least about 825 MPa (120 ksi). Strength of the alloys increases with 4% niobium at the expense of ductility. Chromium provided an insignificant effect on strength and greater than 3.5% chromium reduced ductility.

Table 6 below provides mechanical properties of alloys of Table 4 provided at 704° C.

TABLE 6

EFFECT OF Cr—Nb—Ni ON 704° C. TENSILE PROPERTIES
Base Composition: 27.5 Fe—5.4Al—0.1Ti—Bal. Co
Heat Treatment: 1010° C./1 h, AC + 788° C./16 h FC to 621° C./8 h, AC
0.2% Yield Strength (MPa)/Tensile Strength (MPa)/Elongation %/Reduction of Area %

| | 27 Ni | | 30 Ni | | 33 Ni | |
|---|---|---|---|---|---|---|
| Cr | 3 Nb | 4 Nb | 3 Nb | 4 Nb | 3 Nb | 4 Nb |
| 0 | — | — | 613 | 676 | 724 | 745 |
| | | | 710 | 827 | 848 | 848 |
| | | | 45/88 | 31/81 | 34/80 | 29/78 |
| 2 | — | — | 676 | 745 | 717 | 772 |
| | | | 758 | 882 | 800 | 876 |
| | | | 40/82 | 33/78 | 32/79 | 31/80 |
| 3 | 620 | 634 | 690 | 690 | 758 | 807 |
| | 703 | 724 | 772 | 793 | 903 | 903 |
| | 44/86 | 42/84 | 40/82 | 28/80 | 27/78 | 28/74 |
| 3.5 | 655 | 641 | 683 | — | 800 | 758 |
| | 786 | 745 | 800 | | 889 | 876 |
| | 30/79 | 45/86 | 35/82 | | 36/82 | 40/83 |
| 4 | — | 620 | 690 | 758 | 772 | 786 |
| | | 724 | 841 | 855 | 882 | 917 |
| | | 43/86 | 34/79 | 29/76 | 26/75 | 32/75 |

At elevated temperatures, strength and ductility of all alloys were acceptable. Typical minimum requirements for elevated temperature strength are 590 MPa (85 ksi) 0.2% yield strength (704° C.) and for elevated temperature ductility are 15% elongation (704° C.). Increasing nickel content offered significant improvement in tensile strength at elevated temperature. Generally, chromium and niobium are also somewhat beneficial to these elevated temperature properties.

Table 7 below provides effect of Cr-Nb-Ni on creep (ASTM E-139) at elevated temperature.

TABLE 7

EFFECT OF Cr—Nb—Ni ON 649° C./379 MPa CREEP
Base Composition: 27.5Fe—5.4Al—0.1Ti—Bal. Co
Heat Treatment: 1010° C./1 h, AC + 788° C./16 h FC to 621° C./8 h, AC
Time (h) to 0.2% Strain and Secondary Creep Rate (m/m/h)

| | 27 Ni | | 30 Ni | | 33 Ni | |
|---|---|---|---|---|---|---|
| Cr | 3 Nb | 4 Nb | 3 Nb | 4 Nb | 3 Nb | 4 Nb |
| 0 | — | — | 11.3 | 39.4 | 7.2 | 50.0 |
| | | | $1.3 \times 10^{-4}$ | $2.8 \times 10^{-5}$ | $1.0 \times 10^{-4}$ | $2.3 \times 10^{-5}$ |
| 2 | — | — | 47.6 | 81.3 | 32.1 | 135.2 |
| | | | $2.6 \times 10^{-5}$ | $1.5 \times 10^{-5}$ | $2.8 \times 10^{-5}$ | $7.9 \times 10^{-6}$ |
| 3 | 26.9 | 21.5 | 63.4 | 59.2 | 65.2 | 112.5 |
| | $4.4 \times 10^{-5}$ | $6.2 \times 10^{-5}$ | $2.0 \times 10^{-5}$ | $2.2 \times 10^{-5}$ | $2.1 \times 10^{-5}$ | $1.1 \times 10^{-5}$ |
| 3.5 | 29.6 | 21.6 | 52.9 | 52.1 | 76.1 | 132.2 |
| | $4.3 \times 10^{-5}$ | $4.9 \times 10^{-5}$ | $2.8 \times 10^{-5}$ | $2.1 \times 10^{-5}$ | $1.7 \times 10^{-5}$ | $9.8 \times 10^{-6}$ |
| 4 | 25.2 | 34.5 | 43.2 | 42.7 | 82.7 | 133.1 |
| | $6.9 \times 10^{-5}$ | $3.7 \times 10^{-5}$ | $3.3 \times 10^{-5}$ | $3.4 \times 10^{-5}$ | $1.7 \times 10^{-5}$ | $8.5 \times 10^{-6}$ |

Chromium addition of 2% improved time to 0.2% strain by over 100% and by as much as 400% in comparison to alloys having no chromium. Furthermore, secondary creep rates were reduced by an order of magnitude in material with greater than 2% chromium. Increasing nickel and niobium appeared to have a synergistic effect upon creep properties. In material containing 33% nickel, 4% niobium further increased time to 0.2% strain and reduced secondary creep rates. Most advantageous creep parameters are at least 15 hours to 0.2% strain and a secondary creep rate of less than $5\times10^{-5}$ m/m/hr.

Table 8 below contains the effect of chromium-niobium and nickel upon Charpy V-notch impact energy.

TABLE 8

EFFECT OF Cr—Nb—Ni ON ROOM TEMPERATURE CVN IMPACT ENERGY
Base Composition: 27.5Fe—5.4Al—0.1Ti—Bal. Co
Heat Treatment: 1010° C./1 h, AC + 788° C./ 16 h FC to 621° C./8 h, AC
Charpy V-Notch Impact Energy (N · m)

| | 27 Ni | | 30 Ni | | 33 Ni | |
|---|---|---|---|---|---|---|
| Cr | 3 Nb | 4 Nb | 3 Nb | 4 Nb | 3 Nb | 4 Nb |
| 0 | — | — | 15 | 8 | 27 | 18 |
| 2 | — | — | 14 | 8 | 20 | 12 |
| 3 | 11 | 5 | 15 | 8 | 20 | 11 |
| 3.5 | 9 | 5 | 15 | 9 | 19 | 14 |
| 4 | 8 | 15 | 5 | 8 | 19 | 11 |

The room temperature impact energies provided above are low, but acceptable tier structural turbine applications. The impact energies above are about equivalent to INCOLOY® alloy 909. INCOLOY alloy 909 is successfully being used in structural turbine applications. Increasing nickel was found to increase impact energy. The effect of chromium was insignificant and 4% niobium was found to significantly lower impact energy. Advantageously, the alloy has a room temperature CVN impact energy of at least 5 N.m. Most advantageously room temperature CVN impact energy is at least 10 N.m.

Table 9 below provides the effect of chromium, nickel and niobium upon coefficient of thermal expansion (CTE) at various temperatures.

TABLE 9

EFFECT OF Cr—Nb—Ni ON CTE BEHAVIOR
Base Composition: 27.5Fe—5.4Al—0.1Ti—Bal. Co
Heat Treatment: 1010° C./1 h, AC + 788° C./ 16 h FC to 621° C./8 h, AC
CTE (μm/m/°C.) at 316° C., 427° C. and 649° C.; Inflection Temperature (°C.)

| | 27 Ni | | 30 Ni | | 33 Ni | |
|---|---|---|---|---|---|---|
| Cr | 3 Nb | 4 Nb | 3 Nb | 4 Nb | 3 Nb | 4 Nb |
| 0 | — | — | 11.3 | 11.0 | 11.2 | 10.6 |
| | | | 11.3 | 11.0 | 11.2 | 10.6 |
| | | | 11.9 | 11.9 | 12.1 | 11.7 |
| | | | 619 | 576 | 583 | 555 |
| 2 | — | — | 10.4 | 10.1 | 10.4 | 9.9 |
| | | | 10.4 | 10.3 | 10.4 | 10.3 |
| | | | 12.2 | 12.2 | 12.4 | 12.2 |
| | | | 490 | 470 | 452 | 424 |
| 3 | 10.1 | 9.9 | 10.3 | 9.9 | 9.9 | 9.7 |
| | 10.4 | 10.6 | 10.8 | 10.6 | 10.6 | 10.8 |
| | 12.4 | 12.6 | 12.8 | 12.6 | 12.6 | 12.8 |
| | 405 | 414 | 429 | 388 | 388 | 349 |
| 3.5 | 9.9 | 9.9 | 9.9 | 9.9 | 9.9 | 9.7 |

TABLE 9-continued

EFFECT OF Cr—Nb—Ni ON CTE BEHAVIOR
Base Composition: 27.5Fe—5.4Al—0.1Ti—Bal. Co
Heat Treatment: 1010° C./1 h, AC + 788° C./ 16 h FC to 621° C./8 h, AC
CTE (μm/m/°C.) at 316° C., 427° C. and 649° C.; Inflection Temperature (°C.)

| | 27 Ni | | 30 Ni | | 33 Ni | |
|---|---|---|---|---|---|---|
| Cr | 3 Nb | 4 Nb | 3 Nb | 4 Nb | 3 Nb | 4 Nb |
| | 10.6 | 10.8 | 11.0 | 10.8 | 11.0 | 11.0 |
| | 12.6 | 12.8 | 13.0 | 12.8 | 13.0 | 13.0 |
| | 414 | 396 | 370 | 371 | 377 | 328 |
| 4 | 10.4 | 9.9 | 9.9 | 9.9 | — | — |
| | 11.3 | 11.0 | 11.2 | 11.2 | | |
| | 13.0 | 13.0 | 13.1 | 13.1 | | |
| | 343 | 344 | 340 | 330 | | |

The CTE below the inflection temperature was reduced by 0.9 μm/m/°C. with an addition of 0 to 2% chromium. At temperatures above the inflection temperature, alloys have an increased CTE consistent with paramagnetic behavior. Chromium at 2 to 4% provided little effect upon coefficient of thermal expansion in the ferromagnetic range below the inflection temperature. However, chromium significantly increased the CTE at temperatures above the inflection temperature. However, cobalt tends to increase inflection temperature.

Advantageously, CTE of the alloy is at least 10% lower than alloy 718 or less than 13.6 μm/m/°C. at 649° C. Most advantageously, CTE of the alloy is at least 15% lower than alloy 718 or less than 12.85 μm/m/°C. at 649° C. For alloys of the invention, in addition to a 10% reduction in CTE, it is advantageous in many gas turbine designs to match the slope and inflection temperature of INCONEL alloy 718. For alloys containing 4% chromium, CTE was 26% lower at 316° C., 21% lower at 427° C. and 13% lower at 649° C. For alloys containing 3% chromium, CTE was 26% lower at 316° C., 23% lower at 427° C. and 16% lower at 649° C. Although the slope does not exactly match the slope of INCONEL alloy 718, the slopes are consistent enough to provide engineering advantages when using the alloy of the invention in combination with Alloy 718. Even alloys having a lowered inflection temperature, arising from a 4% chromium addition, had suitable inflection temperatures for gas turbine engine purposes. At temperatures above the inflection temperature, rate of thermal expansion increases significantly.

Linear regression models correlating CTE at 316° C. and 649° C. for alloys nominally containing 27 Fe, 5.5 Al and 3 Nb to predict CTE for various Ni, Co and Cr weight percent combinations were formulated. The models in units of μm/m/°C. formed were as follows:

$$CTE_{316°\,C.}=3.64+0.007(Co)(Ni)-0.281(Cr)+0.045(Cr)^2$$

$$CTE_{649°\,C.}=12.58+0.099(Cr)+0.047(Cr)^2-0.022(Co)$$

Subsequent testing has verified good predictability of the above formulas for a range of about 24–28% iron. Depending upon nickel content, alloys may contain up to 37% cobalt and up to 10% chromium and maintain a CTE 10% below that of alloy 718.

The model for 649° C. restricts maximum chromium content for most advantageous operation at elevated temperature from up to about 5, 5.5 and 6% chromium depending upon cobalt concentration. For applications in which the inflection temperature is not exceeded, increased mounts of chromium will provide desired CTE rates.

Table 10 below illustrates the effect of small mounts of chromium upon corrosion resistance.

TABLE 10

SALT SPRAY TEST RESULTS
Comparisons with Alloy 909 and Alloy 718

| Alloy | Specimen | Cr Content wt. % | Corrosion Rate μm/y | Pit Depth μm |
|---|---|---|---|---|
| 909 | 18 | 0.09 | 15 | 25 |
| 909 | 19 | 0.09 | 18 | 76 |
| 1 | 1 | 0.02 | 2 | 102 |
| 1 | 2 | 0.02 | 5 | 114 |
| 2 | 12 | 1.06 | 0 | 268 |
| 2 | 13 | 1.06 | 0 | 330 |
| 3 | 14 | 3.06 | 0 | 0 |
| 3 | 15 | 3.06 | 0 | 0 |
| 718 | 10 | 18.4 | 0 | 0 |
| 718 | 11 | 18.4 | 0 | 0 |

Notes:
1. See Table 3 for complete compositions.
2. Salt spray fog testing conducted at 35° C. exposed for 720 hours, in conformance to ASTM B117-85.

Material containing 3% chromium was unexpectedly found to eliminate corrosion arising from a salt spray test in accordance with ASTM B117-85. However, the addition of only 1% chromium was found to accelerate pitting type corrosion. Corrosion rates for material containing 3% chromium were excellent in comparison to alloys containing 1% chromium and much improved over INCOLOY alloy 909. It is believed that molybdenum may be substituted wholly or in part for chromium for salt spray resistance.

Table 11 contains the effect of chromium, niobium and nickel upon static crack life at 538° C.

TABLE 11

EFFECT OF Cr—Nb—Ni ON 538° C.
STATIC CRACK LIFE
Base Composition: 27.5Fe—5.4Al—0.1Ti—Bal. Co
Heat Treatment: 1010° C./1 h, AC + 788° C./
16 h FC to 621° C./8 h, AC
25.4 mm Compact Tension Specimens
Total Crack Life in Hours from Initial
Stress Intensity of 27 MPa √m

| | 27 Ni | | 30 Ni | | 33 Ni | |
|---|---|---|---|---|---|---|
| Cr | 3 Nb | 4 Nb | 3 Nb | 4 Nb | 3 Nb | 4 Nb |
| 0 | — | — | 4.5 | — | — | 2.7 |
| 2 | — | — | 33.3 | 22.6 | 11.8 | 4.2 |
| 3 | 345.5 | PCF | 106.8 | 213.7 | 29.1 | 15.9 |
| 3.5 | 383.6 | PCF | 58.1 | 58.7 | 38.7 | 19.5 |
| 4 | 393.6 | PCF | 342.4 | 175.1 | 48.6 | 51.4 |

PCF = Pre-crack Failure

At temperatures of about 538° C. an alloy such as INCOLOY alloys 907 and 909 have an increased sensitivity to cracking. The time to fracture or crack life of compact tension sustained load was improved by one to two orders of magnitude. The increased crack life was particularly pronounced in alloys containing lower nickel concentrations and increased cobalt concentrations. Niobium appeared to provide either no effect or a slight negative effect in higher nickel alloys. The pre-cracking fractures of alloys containing 4% niobium and 27% nickel indicated brittle behavior at room temperature. Advantageously, the alloy of the invention has a crack life of 10 hours at an initial stress intensity of 27 MPa√m and a temperature of 538° C. Most advantageously, the alloy of the invention has a crack life of 20 hours at an initial stress intensity of 27 MPa√m and a temperature of 538° C.

Table 12 contains the effect of chromium, niobium and nickel on static growth rate at 538° C.

TABLE 12

EFFECT OF Cr—Nb—Ni ON 538° C.
STATIC CRACK GROWTH RATE
Base Composition: 27.5Fe—5.4Al—3Nb—0.1Ti—Bal. Co
Heat Treatment: 1010° C./1 h, AC + 788° C./
16 h FC to 621° C./8 h, AC
Initial Stress Intensity = 27 MPa √m
Crack Growth Rate (mm/s)

| Cr | Stress Intensity MPa √m | 27 Ni | 30 Ni | 33 Ni |
|---|---|---|---|---|
| 0 | 33 | — | $4.2 \times 10^{-4}$ | VT |
| | 55 | — | $2.1 \times 10^{-3}$ | VT |
| 2 | 33 | — | $8.5 \times 10^{-5}$ | $2.1 \times 10^{-4}$ |
| | 55 | — | $4.2 \times 10^{-4}$ | $8.5 \times 10^{-4}$ |
| 3 | 33 | $4.2 \times 10^{-6}$ | $2.1 \times 10^{-5}$ | $1.3 \times 10^{-4}$ |
| | 55 | $4.2 \times 10^{-5}$ | $2.1 \times 10^{-4}$ | $4.2 \times 10^{-4}$ |
| 3.5 | 33 | $4.2 \times 10^{-6}$ | $2.1 \times 10^{-5}$ | $4.2 \times 10^{-5}$ |
| | 55 | $4.2 \times 10^{-5}$ | $1.7 \times 10^{-4}$ | $3.0 \times 10^{-4}$ |
| 4 | 33 | $2.1 \times 10^{-6}$ | $3.0 \times 10^{-6}$ | $3.0 \times 10^{-5}$ |
| | 55 | $2.1 \times 10^{-5}$ | $4.2 \times 10^{-5}$ | $2.5 \times 10^{-4}$ |
| Alloy 718 | 33 | $1.3 \times 10^{-5}$ | — | — |
| | 55 | $4.2 \times 10^{-5}$ | — | — |

VT = Voided Test

Table 12 illustrates that static crack growth rates of alloys containing at least 2% chromium provided a one or two order of magnitude decrease in crack growth rate. Alloys containing 30% or less nickel were particularly crack growth resistant. The crack growth rates of alloys containing 27% nickel were essentially equivalent to crack growth rates of conventionally heat treated alloy 718. Referring to FIG. 1, crack growth resistance of alloys are improved by one or two orders of magnitude by including at least 2% chromium. The alloy of the '072 publication has been found to be less defect or damage tolerant than desired for certain structural applications. Alloys of the invention containing at least 2% chromium are within an order of a magnitude of alloy 718. In fact, some alloys at stress intensities up to about 50 MPa√m have greater crack growth resistance than alloy 718.

Figure 2:
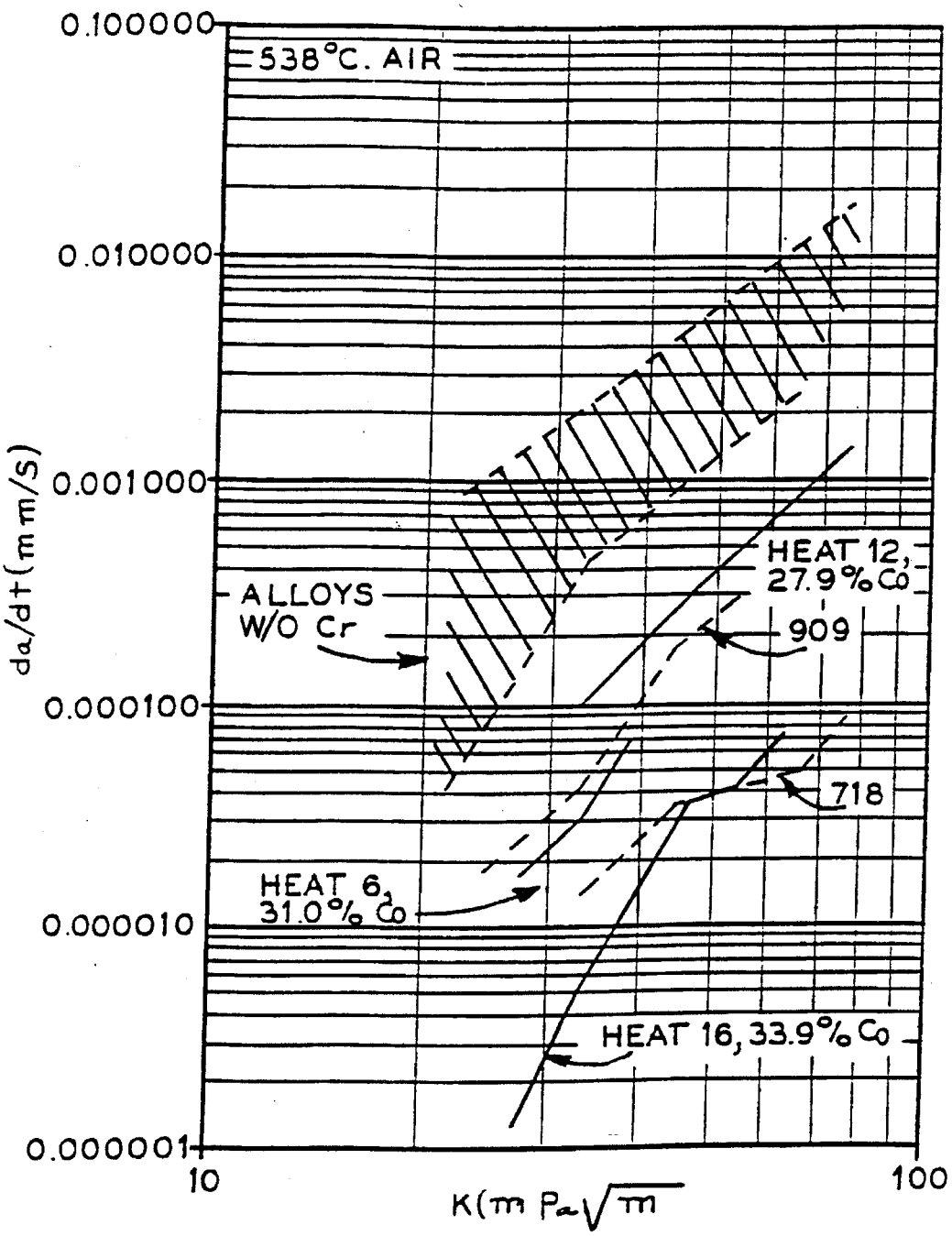
FIG. 2 is a plot of static crack growth at 538° C. as measured in a transverse-longitudinal direction illustrating the effect of Ni on crack growth rate. Heats 6, 12 and 16 were annealed at 1010° C. for 1 hour, air cooled, aged at 788° C. for 16 hours, furnace cooled to 621° C., aged at 621° C. for 8 hours and air cooled.

In particular, FIG. 2 illustrates the advantage of decreasing nickel concentrations and increasing cobalt concentrations upon crack growth resistance. Decreasing nickel from 33% to 27% with increasing cobalt from 28% to 34% provided for improved crack growth resistance properties. Specifically, heat number 16 containing 2.95 Cr with 27% Ni, 34% Co and 28% Fe provided an advantageous combination of crack growth resistance properties.

Table 13 contains a representative chromium-free alloy of the '072 publication for comparison.

TABLE 13

EFFECT OF HEAT TREATMENT ON 538° C.
STATIC CRACK GROWTH RATE
Heat: 1
Product: Flat 2.5 cm × 10.2 cm
Heat Treatment: Anneal Shown/1 h, AC + Age
Temp. Shown/ 16 h FC (38° C./h)
to 621° C./8 h, AC
25.4 mm Compact Tension Specimens
Crack Growth Rate (mm/s) at Stress Intensity Shown
Initial Stress Intensity = 27 MPa √m

| Aging | Stress Intensity | Annealing Temperature | | |
|---|---|---|---|---|
| Temp. | MPa √m | 982° C. | 1010° C. | 1038° C. |
| 760° C. | 33 | $1.7 \times 10^{-3}$ | $1.3 \times 10^{-3}$ | $1.3 \times 10^{-3}$ |

TABLE 13-continued

EFFECT OF HEAT TREATMENT ON 538° C.
STATIC CRACK GROWTH RATE
Heat: 1
Product: Flat 2.5 cm × 10.2 cm
Heat Treatment: Anneal Shown/1 h, AC + Age Temp. Shown/ 16 h FC (38° C./h) to 621° C./8 h, AC
25.4 mm Compact Tension Specimens
Crack Growth Rate (mm/s) at Stress Intensity Shown
Initial Stress Intensity = 27 MPa √m

| Aging Temp. | Stress Intensity MPa √m | Annealing Temperature 982° C. | 1010° C. | 1038° C. |
|---|---|---|---|---|
| | 55 | $8.5 \times 10^{-3}$ | $4.2 \times 10^{-3}$ | $4.2 \times 10^{-3}$ |
| 788° C. | 33 | $8.5 \times 10^{-4}$ | $8.5 \times 10^{-4}$ | $8.5 \times 10^{-4}$ |
| | 55 | $3.4 \times 10^{-3}$ | $3.4 \times 10^{-3}$ | $3.0 \times 10^{-3}$ |
| 816° C. | 33 | $3.4 \times 10^{-4}$ | $8.5 \times 10^{-4}$ | $8.5 \times 10^{-4}$ |
| | 55 | $3.4 \times 10^{-3}$ | $4.2 \times 10^{-3}$ | $4.2 \times 10^{-3}$ |
| 843° C. | 33 | PCF | $8.5 \times 10^{-4}$ | $8.5 \times 10^{-4}$ |
| | 55 | | $8.5 \times 10^{-3}$ | $3.4 \times 10^{-3}$ |
| Alloy 718 | 33 | $1.3 \times 10^{-5}$ | | |
| | 55 | $4.2 \times 10^{-5}$ | | |

PCF = Pre-crack Failure

The composition of Table 13 nominally contained, by weight percent, 33Ni- 31Co-27Fe-5.3Al-3.0Nb with only 0.02 chromium. Crack growth rates for the alloy of Table 11 were much greater than alloy 718. In addition, heat treatment only slightly affected crack growth rates.

Table 14 provides the effect of various heat treatments on static crack growth rate at 538° C.

TABLE 14

EFFECT OF HEAT TREATMENT ON 538° C.
STATIC CRACK GROWTH RATE
Heat: 3
Product: Flat 0.89 cm × 6.4 cm
Heat Treatment: Anneal Shown/1 h, AC + Age Temp. Shown/ 16 h FC (38° C./h) to 621° C./8 h, AC
25.4 mm Compact Tension
Crack Growth Rate (mm/s) at Stress Intensity Shown
Initial Stress Intensity = 27 MPa √m

| Aging Temp. | Stress Intensity MPa √m | Annealing Temperature 982° C. | 1024° C. | 1066° C. |
|---|---|---|---|---|
| 760° C. | 33 | $8.5 \times 10^{-6}$ | $8.5 \times 10^{-5}$ | $1.7 \times 10^{-4}$ |
| | 55 | $2.1 \times 10^{-4}$ | $4.2 \times 10^{-4}$ | — |
| 801° C. | 33 | $8.5 \times 10^{-6}$ | $4.2 \times 10^{-5}$ | $1.3 \times 10^{-4}$ |
| | 55 | $1.3 \times 10^{-4}$ | $4.2 \times 10^{-4}$ | $8.5 \times 10^{-4}$ |
| 843° C. | 33 | $4.2 \times 10^{-6}$ | $2.5 \times 10^{-5}$ | $3.4 \times 10^{-5}$ |
| | 55 | $4.2 \times 10^{-5}$ | | $3.4 \times 10^{-4}$ |

TABLE 14-continued

EFFECT OF HEAT TREATMENT ON 538° C.
STATIC CRACK GROWTH RATE
Heat: 3
Product: Flat 0.89 cm × 6.4 cm
Heat Treatment: Anneal Shown/1 h, AC + Age Temp. Shown/ 16 h FC (38° C./h) to 621° C./8 h, AC
25.4 mm Compact Tension
Crack Growth Rate (mm/s) at Stress Intensity Shown
Initial Stress Intensity = 27 MPa √m

| Other Heat Treatment: | Stress Intensity MPa √m | 1010° C. |
|---|---|---|
| 788° C. | 33 | $4.2 \times 10^{-5}$ |
| | 55 | $4.2 \times 10^{-4}$ |
| | | 1066° C. |
| 899° C./4* | 33 | $2.1 \times 10^{-5}$ |
| | 55 | $2.5 \times 10^{-4}$ |
| Alloy 718 | 33 | $1.3 \times 10^{-5}$ |
| | 55 | $4.2 \times 10^{-5}$ |

*899° C./4 h FC (38° C./h) to 621° C./8 h, AC

Figure 3:
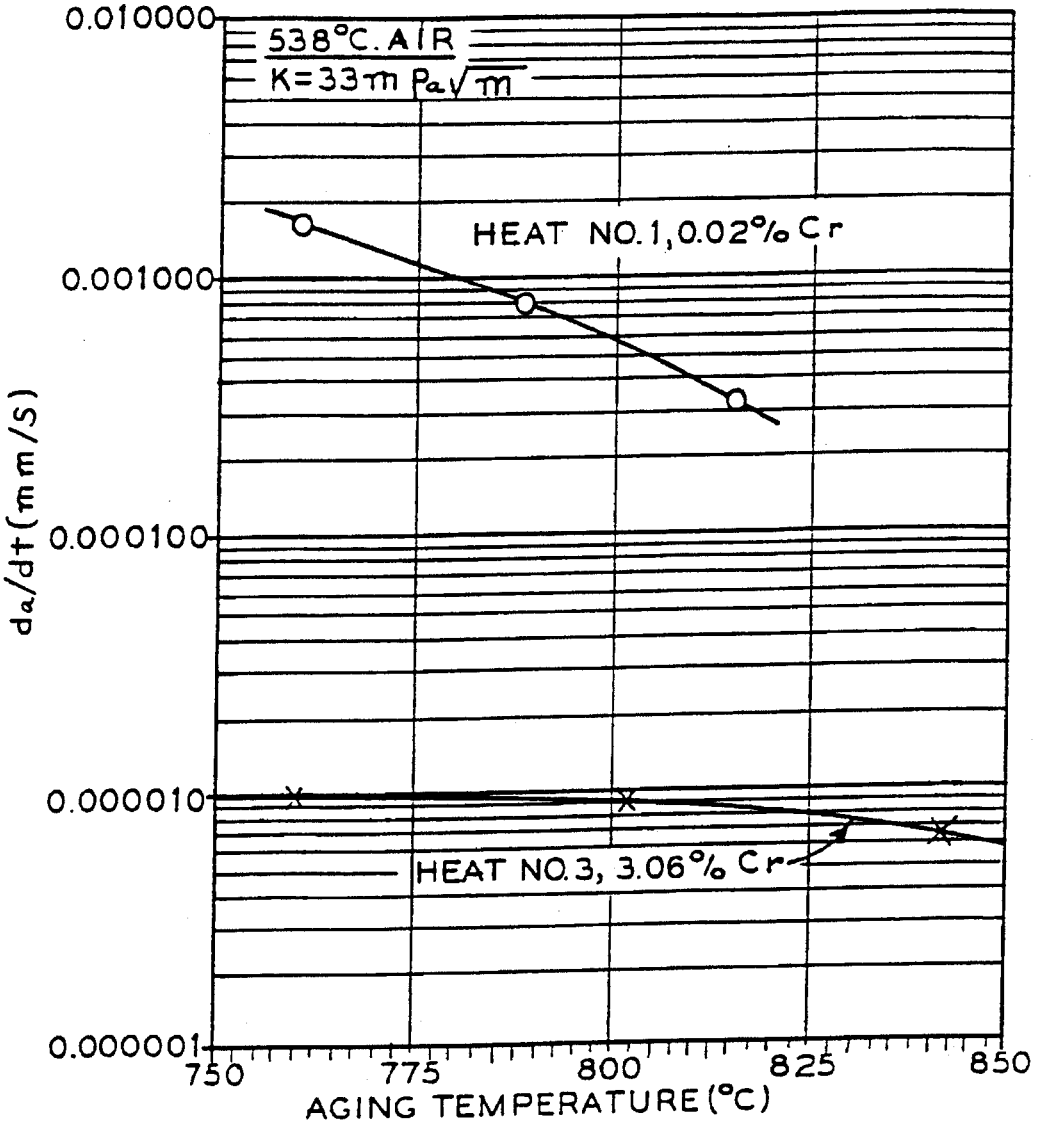
FIG. 3 is a plot of static crack growth at 538° C. for alloys annealed at 982° C. having different amounts of chromium in a transverse-longitudinal direction at a stress intensity of 33 MPa√m. The alloys were given a 1 hour anneal at 982° C., air cooled to 621° C., held 8 hours at 621° C. and air cooled.

The composition of Table 14 nominally contained, by weight percent, 34Ni-Co- 24Fe-5.4Al-3.1Cr-3.0Nb. In contrast to the alloy of Table 13, the 3% chromium alloy was positively affected by heat treatment. Referring to FIG. 3, crack growth rates of the invention upon annealing and aging treatments improved to a rate approaching the crack growth rates of alloy 718. Crack growth rates of the alloy of the '072 invention were unacceptably high and not improved sufficiently by heat treatment.

Figure 4:
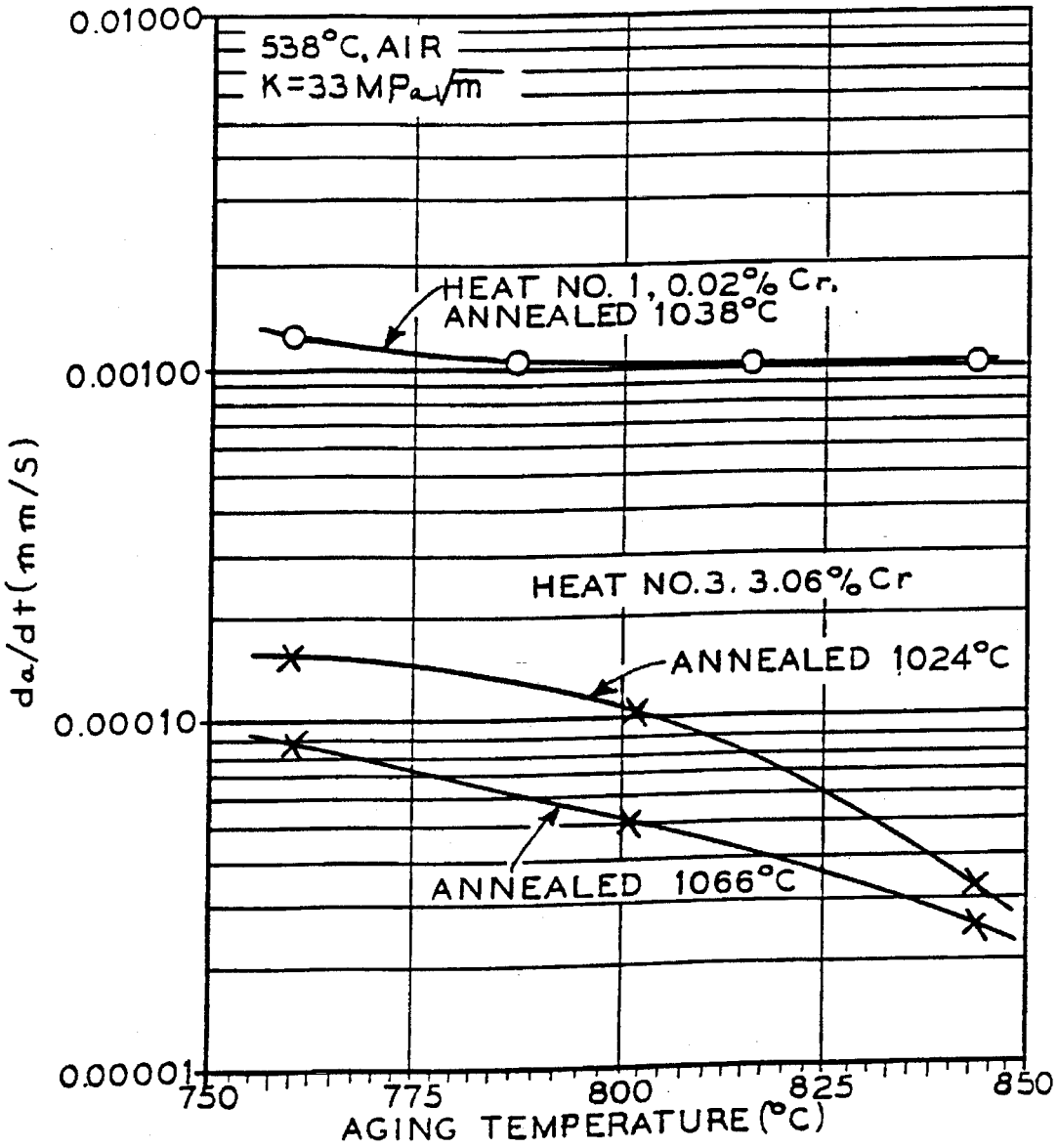
FIG. 4 is a plot of static crack growth at 538° C. for alloys annealed and aged at different temperatures in a transverse-longitudinal direction at a stress intensity of 33 MPa √m. The alloys were annealed 1 hour, air cooled. Aging treatment consisted of the temperature indicated on the Figure for 16 hours, furnace cooling and 621° C. for 8 hours followed by air cooling.

Alloys of the present invention consist essentially of a three phase structure. The primary matrix is an austenitic face centered cubic or gamma phase. The gamma phase is strengthened by precipitation of gamma prime phase. Beta phase or phases provide SAGBO resistance. Referring to FIG. 4, after higher annealing temperatures, crack growth resistance was improved by increasing aging temperature and by a β phase precipitation heat treatment. The beta phase forms at annealing temperatures below about 1090° C. (2000° F.). Beta phase forms most profusely at about 750°–1000° C. (1382°–1832° F.). The higher temperature aging treatments may be particularly useful after high temperature brazing. The beta phase precipitation heat treatment is believed to contribute to reduction of crack growth rates. The aging temperatures in combination with cooling paths, such as cooling between furnace heat treatments at different temperatures primarily control the morphology, of the gamma prime strengthening phase.

Table 15 below provides the effect of Cr, Ni, anneal and age upon crack growth rate.

TABLE 15

EFFECT OF Cr, Ni, ANNEAL & AGE
538° C. da/dt (mm/s) @ K = 33 & 55 MPa √m

| | | 2% Cr | | | | 3% Cr | | | |
|---|---|---|---|---|---|---|---|---|---|
| | | 30% Ni Heat 5 da/dt (mm/s) @ | | 33% Ni Heat 11 da/dt (mm/s) @ | | 30% Ni Heat 6 da/dt (mm/s) @ | | 33% Ni Heat 12 da/dt (mm/s) @ | |
| Anneal | Age | K33 | K55 | K33 | K55 | K33 | K55 | K33 | K55 |
| 982° C. | 760° C. | $4.2 \times 10^{-5}$ | $3.0 \times 10^{-4}$ | $8.5 \times 10^{-5}$ | $4.2 \times 10^{-4}$ | $1.7 \times 10^{-5}$ | $1.3 \times 10^{-4}$ | $4.2 \times 10^{-5}$ | $2.5 \times 10^{-4}$ |
| | 802° C. | $1.7 \times 10^{-5}$ | $1.7 \times 10^{-4}$ | $3.8 \times 10^{-5}$ | $2.5 \times 10^{-4}$ | $4.2 \times 10^{-6}$ | $3.4 \times 10^{-5}$ | $8.5 \times 10^{-6}$ | $8.5 \times 10^{-5}$ |
| | 843° C. | $8.5 \times 10^{-6}$ | $8.5 \times 10^{-5}$ | $2.1 \times 10^{-5}$ | $1.7 \times 10^{-4}$ | $4.2 \times 10^{-6}$ | $3.4 \times 10^{-5}$ | $8.5 \times 10^{-6}$ | $8.5 \times 10^{-5}$ |
| 1038° C. | 760° C. | $1.3 \times 10^{-4}$ | $4.2 \times 10^{-4}$ | $2.5 \times 10^{-4}$ | $8.5 \times 10^{-4}$ | VT | VT | $1.7 \times 10^{-4}$ | $1.7 \times 10^{-3}$ |

TABLE 15-continued

EFFECT OF Cr, Ni, ANNEAL & AGE
538° C. da/dt (mm/s) @ K = 33 & 55 MPa √m

| | | 2% Cr | | | | 3% Cr | | | |
|---|---|---|---|---|---|---|---|---|---|
| | | 30% Ni Heat 5 da/dt (mm/s) @ | | 33% Ni Heat 11 da/dt (mm/s) @ | | 30% Ni Heat 6 da/dt (mm/s) @ | | 33% Ni Heat 12 da/dt (mm/s) @ | |
| Anneal | Age | K33 | K55 | K33 | K55 | K33 | K55 | K33 | K55 |
| | 802° C. | $8.5 \times 10^{-5}$ | $3.8 \times 10^{-4}$ | $1.3 \times 10^{-4}$ | $4.2 \times 10^{-4}$ | $2.1 \times 10^{-5}$ | $1.7 \times 10^{-4}$ | $4.2 \times 10^{-5}$ | $3.4 \times 10^{-4}$ |
| | 843° C. | $3.4 \times 10^{-5}$ | $3.0 \times 10^{-4}$ | $4.2 \times 10^{-5}$ | $3.8 \times 10^{-4}$ | $8.5 \times 10^{-6}$ | $8.5 \times 10^{-5}$ | $3.8 \times 10^{-5}$ | $3.0 \times 10^{-4}$ |

NOTES:
1) da/dt rates within 718 da/dt scatter band shown in bold figures.
2) Anneal: Temperature as shown/1 h, AC
3) Age: Temperature as shown/16 h, furnace cooled to 621° C./8 h, AC.
4) da/dt data derived from smooth da/dt versus stress intensity curves.
5) Test specimens were 7.62 mm thick × 24.4 mm width compact tension specimens fatigue precracked to 1.27 mm depth in accordance with ASTM E647.

6) VT = Voided test

The data from Table 15 confirm the positive effect of chromium upon crack growth rate. Furthermore, decreased nickel content also appeared to decrease crack growth rate. In addition to compositional changes, annealing temperatures and aging temperatures may also be manipulated to further increase crack growth resistance. The crack growth behavior of the alloy of the invention appears to be highly dependent upon morphology, volume percent and location of phases precipitated within the alloy. A much lower volume percent of globular beta type phase is required when precipitates are present in the grain boundaries. It is also believed that beta ordering and transformation may play a role in crack growth resistance.

Figure 5:
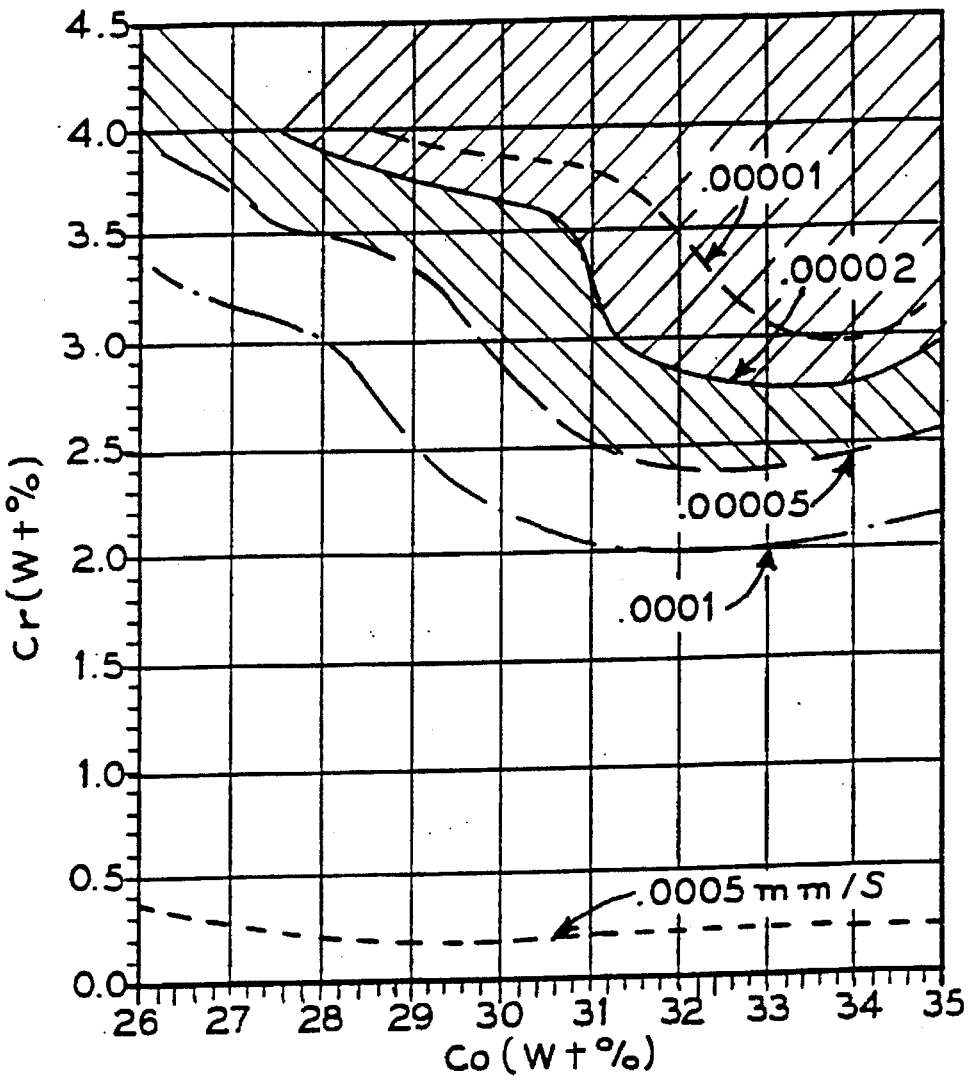
FIG. 5 is a plot demonstrating the effect of chromium and cobalt contents on the static crack growth rate of samples at 538° C. tested at a stress intensity of 33 MPa√m tested in a transverse-longitudinal direction.
Figure 7:
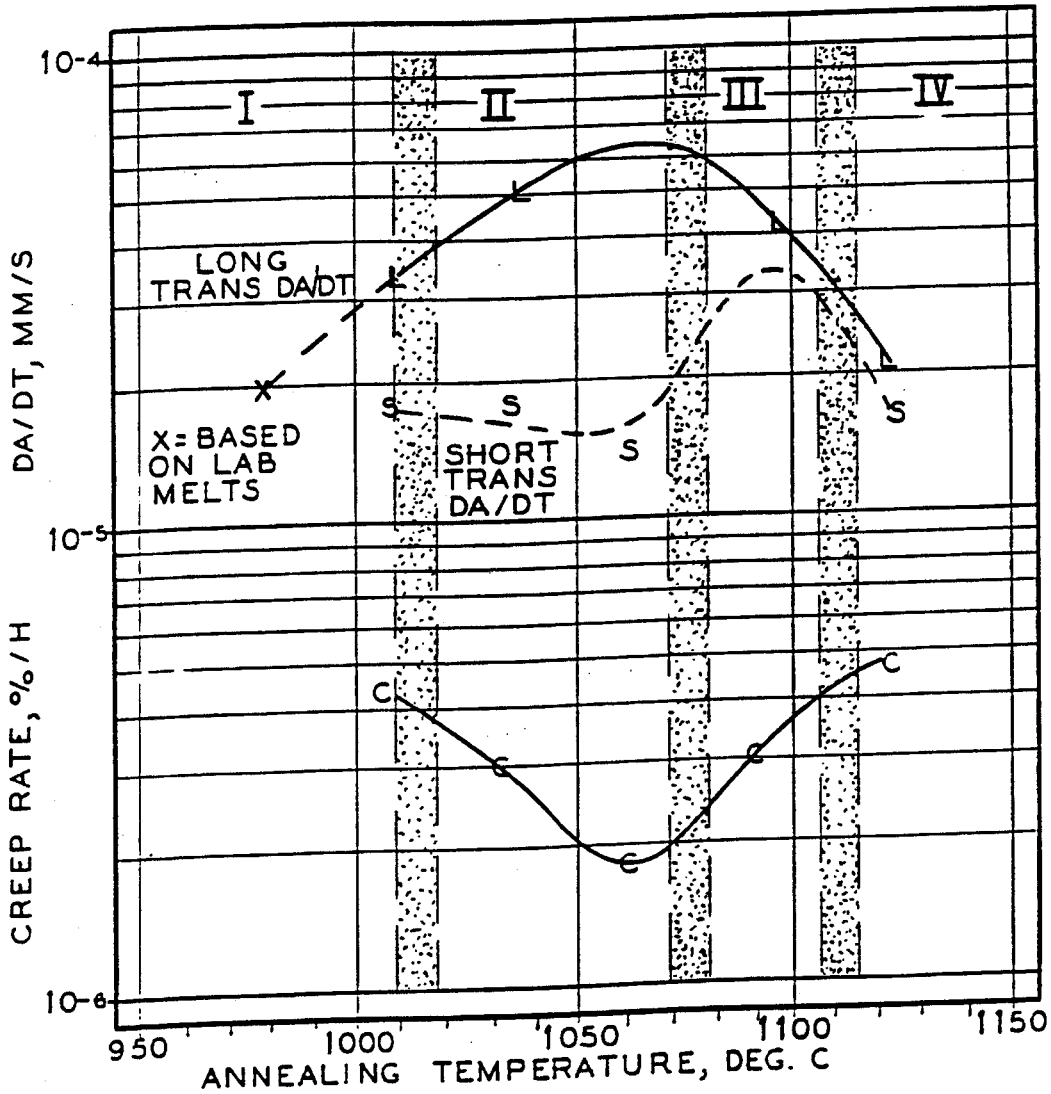
FIG. 7 is a plot illustrating relationship between da/dt rates, crack plane orientation, secondary creep rate, annealing temperature and morphology.

Referring to FIG. 5, cobalt and chromium concentrations each significantly affect crack growth rate. Data for FIG. 5 was based on alloys that contained 24.5 to 27.5% Fe and 27 to 34% Ni. All alloys were annealed 1 hour at 1010° C., air cooled, aged at 778° C. 16 hours, furnace cooled to 621° C., aged 8 hours at 621° C. and air cooled. FIG. 7 illustrates that a high concentration of cobalt in combination with an unexpectedly small concentration of chromium provides improved crack growth resistance properties. Advantageously, the alloy of the invention has a crack growth rate of less than $1\times10^{-4}$ mm/s at a stress intensity of 33 MPa√m and a temperature of 538° C. Most advantageously, the crack growth rate is less than $5\times10^{-5}$ mm/s at a stress intensity of 33 MPa√m and a temperature of 538° C.

Figure 6:
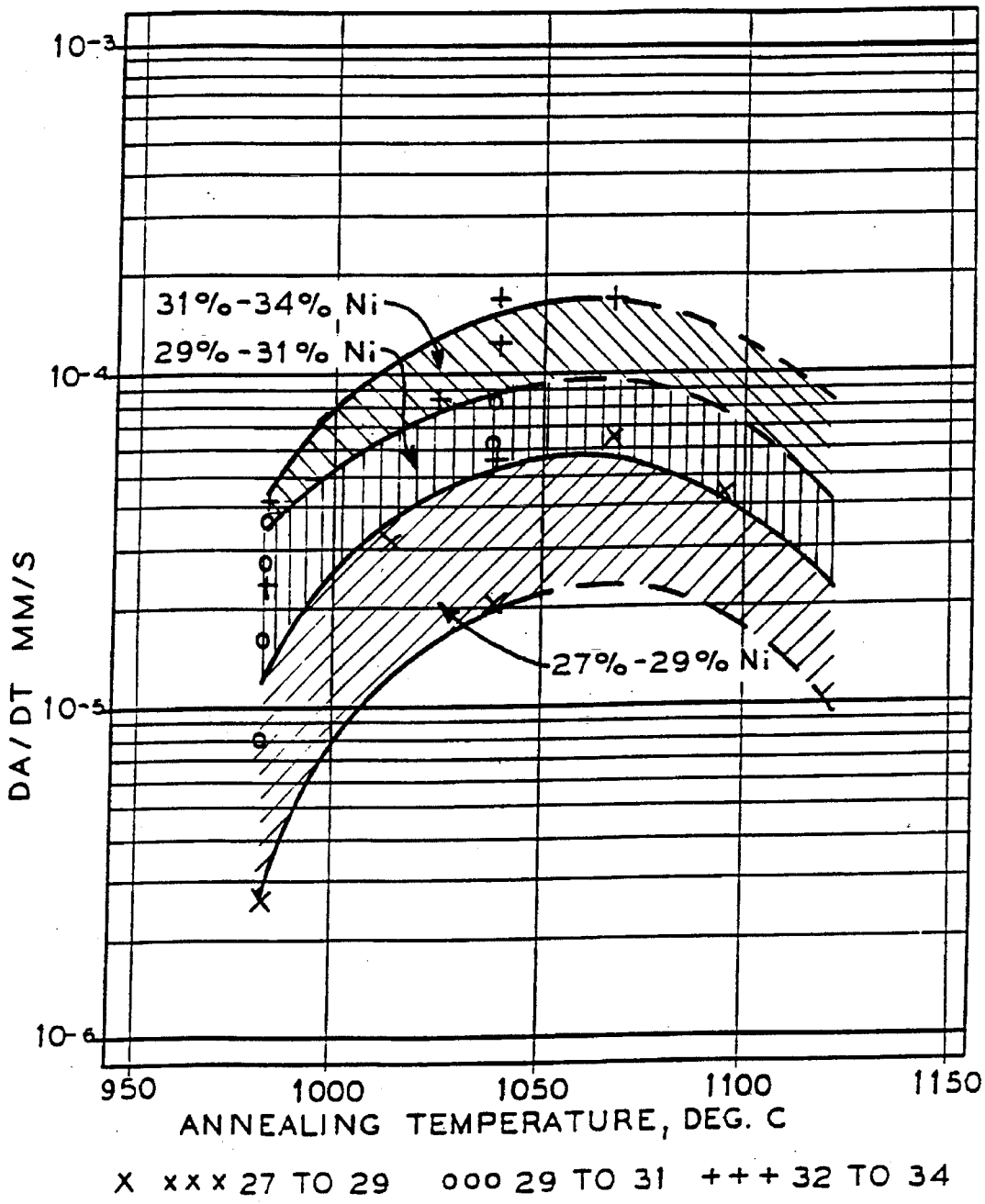
FIG. 6 is a plot showing the effect of annealing temperature on da/dt as a function of Ni content for material receiving aging treatments of less than 1450° F. (788° C.).

Referring to FIG. 6, decreasing nickel content slows crack growth rates for alloys given a predominantly gamma-prime precipitation heat treatment. Maximum crack growth rates occur after annealing temperatures between 1900° F. (1038° C.) and 2000° F. (1093° C.). Minimum rates occur after annealing temperatures around about 1800° F. (982° C.) or 2050° F. (1121° C.).

The effect of Ni is highly significant, but especially so when material is annealed between 1900° and 2000° F. (1038° and 1093° C.). Ni contents less than 27% provide excellent da/dt resistance and crack initiation resistance. Heats containing 24% showed significant crack arrest, which impaired ability to measure crack growth rate. (The plot of FIG. 6 is actually a maximum possible crack growth that does not account for the blunting of cracks that actually stopped crack growth during testing.) However, alloys with only 24% Ni have reduced stability, RTT strength and ductility, and lowered stress rupture life with high ductility. However, this reduction in mechanical properties, for alloys having 24% Ni, is not to a level unacceptable for several commercial applications. Furthermore, for an optimum combination of properties for some applications, it is recommended that above 24% nickel be present in the alloy.

The da/dt correlations with annealing temperature and Ni content are for aging heat treatments which do not contribute to da/dt resistance. Thus, the plot indicates that optimum Ni contents are between about 26% and 29% if 1900° F. anneals are to be considered, or up to about 34% Ni with 1800° F. (982° C.) or 2050° F. (1121° C.) anneals, followed by lower temperature aging treatments.

It is presently believed that increasing Ni at the expense of Co either stabilizes gamma prime at the expense of beta phases, or alters the structures and/or composition of beta phase in some manner to increase creep resistance or to assist grain boundary oxygen diffusion or both.

Heat number 30 was obtained from an approximately 4,000 Kg vacuum induction melted and vacuum arc remelted ingot. Referring to FIG. 7, an engine ring 2" (5.08 cm) thick×4" (10.16 cm) high×28" (71.12 cm) OD of Heat 30 was tested, annealed as shown and aged at 1400° F. (760° C.) for 12 h, furnace cooled to 1150° F. (621° C.) for 8 h and air cooled.

The secondary creep rate decreased with increased annealing temperature, as usual with creep resistant superalloys, up to 1950° F. (1066° C.). Co-incident with the decreasing creep rates is an accelerating da/dt rate in the long transverse plane, again as expected. However, da/dt in the short transverse plane did not vary until the annealing temperature exceeded 1950° F.(1066° C.), when it significantly increased and became equivalent to the da/dt of the long transverse plane.

After reaching a minima with the 1950° F. (1066° C.) anneal, the creep rate increased with 2000° F. (1093° C.) and 2050° F. (1139° C.) anneals. The long transverse da/dt correspondingly decreased with the same anneals. The short transverse da/dt also decreased with the 2050° (1139° C.) anneal.

This property behavior was different from that of most superalloys given elevated temperature solution treatments. Generally, creep rates continue decreasing with higher annealing temperatures and the resulting coarser grain sizes. And superalloys subject to environmentally assisted crack growth typically show significantly higher crack growth rates with coarser grain sizes.

The da/dt and creep rate versus annealing temperature behavior is partly explained by accompanying microstructural changes. Four microstructural "classes" can be distinguished as the annealing temperature increases.

After a low temperature anneal of about 1850° F. (1010° C.) or lower (class I), the microstructure contains fine grain, very abundant fine and coarse beta phase particles, in a duplex, "aggregate" structure with grain boundary precipitates. Much of the coarse beta has been precipitated during prior processing. Since beta is softer than the matrix at hot working temperatures, beta formed before and during processing becomes anisotropic. With the fine grain and abundant beta, creep resistance is lower and creep rates are higher. With greater creep plasticity to aid crack tip blunting, together with grain boundary precipitate and longer crack paths (due to finer grain and coarse beta anisotropy) to slow oxygen diffusion, the da/dt rates tend to be low, even with gamma-prime precipitation during low temperature aging heat treatments (<1450° F. or 788° C.).

In class II, as the annealing temperature increases, grain boundary beta precipitated during processing begins to solutionize and grains begin coarsening. Coarse intra-granular beta appears to retain its anisotropy within annealing class II. With grain coarsening and lower overall beta content, creep rates decrease. The long transverse da/dt increases with little grain boundary beta to slow oxygen diffusion and more favorable crack paths due to coarsened grain. However, the short transverse da/dt remains relatively unchanged and low, since the crack plane must intersect and either pass through or around the elongated beta particles. These beta particles serve to either blunt cracks (due to localized micro-creep plasticity) and/or to re-distribute crack tip stress and strain fields.

Both the maximum long transverse crack growth rate and the minimum creep resistance occur with a 1950° F. (1066° C.) anneal. With this anneal, there is very little grain boundary precipitate, grain size has coarsened to about ASTM #6 to #4 (46 μm to 89 μm), but there is still coarse elongated intra-granular beta (some of which pin grain boundary triple-points).

Class III occurs with an annealing temperature of at least about 1950° F. (1066° C.). The abundance of beta is significantly reduced and the remaining beta particles are now isotropic. There is sparse intergranular precipitate. Grain size is slightly coarsened over that of 1950° F. annealed material and is isotropic.

Significantly, the short transverse crack growth rate is now higher and equivalent to the long transverse crack growth rate, most likely since there is now no elongated beta to help slow crack growth along this orientation.

Interestingly, however, long transverse da/dt is slightly lower and the creep rate is slightly higher. This is believed to suggest that some sub-microscopic beta is being precipitated, or that the gamma-prime structure is being altered. It is also noted that transformations in atomic ordering of the beta phase may alter the creep mechanism.

In class IV, after a 2050° F. (1121° C.) anneal, beta re-precipitation has begun in both the grain interior and particularly within the grain boundaries. This precipitation has apparently occurred during the 1400° F. (760° C.) aging heat treatment cycle, upon cooling from the 2050° F. (1121° C.) anneal, or both. Compared to the beta precipitated during thermomechanical processing, this beta tends toward very fine discrete particulates in the grain boundaries, and may even have a fine lath appearance in the grain interiors. With the re-appearance of the beta, the creep rate increases slightly and both the long and short transverse crack growth rates decrease.

Figure 8A:
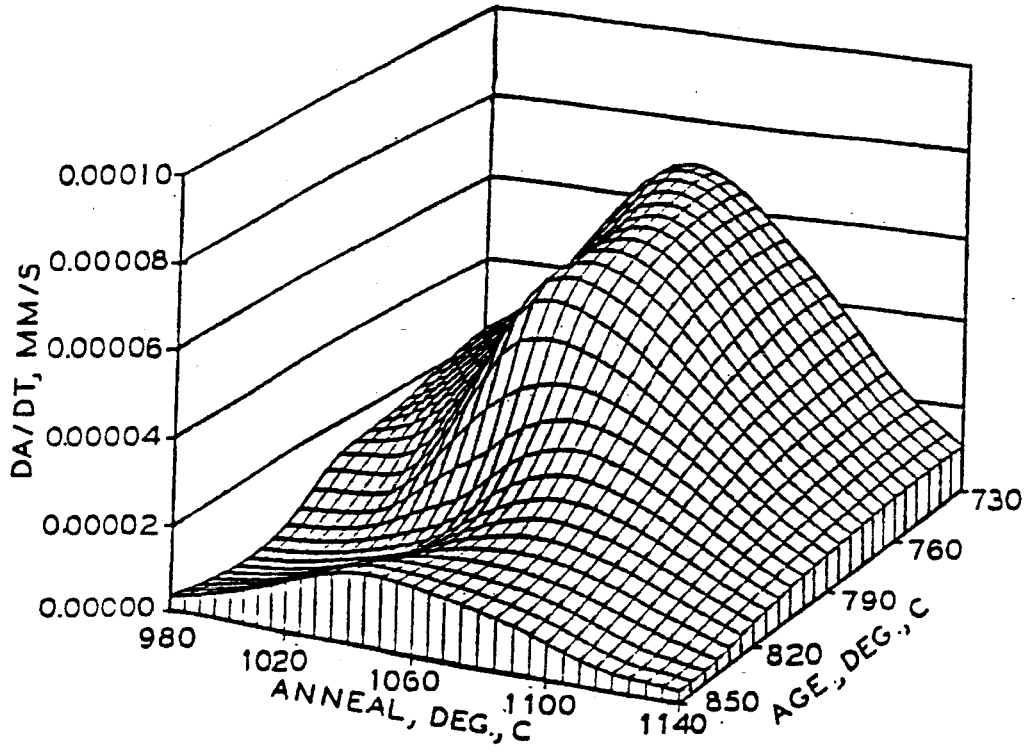
FIGS. 8A and 8B are three dimensional plots illustrating the overall effects of annealing and aging upon 1000° F. (538° C.) crack growth rates for alloys having 27 to 32% nickel at a stress intensity of K=30Ksi√in (33 MPa√m) of samples annealed for one hour at temperature shown, aged at temperature shown for 16 hours, furnace cooled to 1150° F. (621° C.), held for 8 hours and air cooled.
Figure 8B:
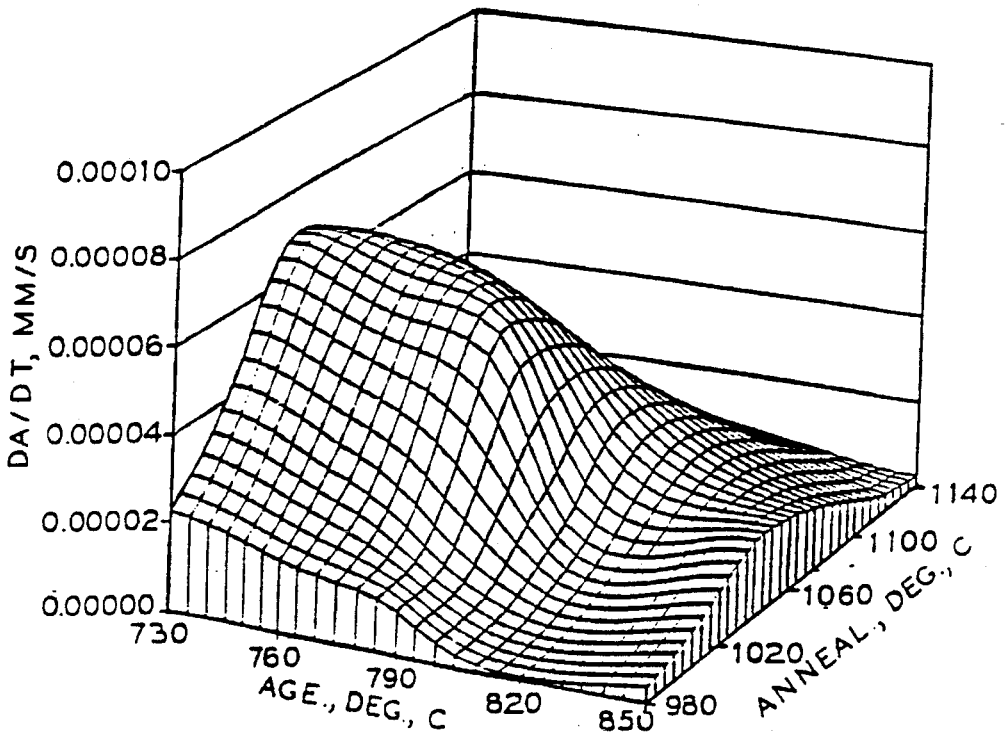

FIGS. 8A and 8B illustrate the overall effects of annealing and aging temperatures on 538° C. da/dt, the mean da/dt at K=33 MPa√m for heats with Ni contents ranging from 27% to 32% were used to develop the contours of FIGS. 8A and 8B.

Advantageously, crack growth rate (da/dt), at K=33 Mpa√m and a temperature of 538° C. is about $1\times10^{-4}$ mm/s or less. This is the approximate da/dt of INCOLOY alloy 909 in the fine grain condition (eg., 1800° F. or 982° C. anneal). Most advantageously da/dt would be $5\times10^{-5}$ mm/s or less under these conditions, the approximate da/dt of INCONEL alloy 718 following a fine grain, delta-precipitating anneal (eg., 1750° F.–1800° F., 954° C.–982° C.). It has been discovered that reduced crack growth rates can be achieved in a variety of ways via three distinctive heat treatments that each of which provide specific advantages and disadvantages:

1) Low temperature anneal (≦1850° F., 1010° C.): Crack growth rates under $10\times10^{-5}$ inches/minute ($4.2\times10^{-5}$ mm/s) are achievable with an 1850° F. (1010° C.) anneal and rates of $5\times10^{-5}$ minute ($2.1\times10^{-6}$ inches mm/s) are achievable with an 1800° F. (982° C.) anneal. Even lower da/dt is possible with overaging (>1450° F., 788° C.) aging heat treatments.

Advantages: 1) Highest yield strength is attained with low temperature anneals; 2) the da/dt is less sensitive to the aging heat treatment, permitting a wide selection of aging temperatures; and 3) low temperature anneals are compatible with those for alloys such as alloy 718 (Permitting alloy joined to alloy 718 to be readily heat treated together.).

Disadvantages: 1) The material is more sensitive to prior thermomechanical processing history; 2) anisotropy of coarser beta grains precipitated during processing may cause anisotropic mechanical properties; 3) with more abundant and coarse beta particles material may be more prone to ductility losses after long time intermediate temperature exposures; 4) reduced creep resistance due to fine grain and abundant beta phases; and 5) not compatible with high temperature brazing heat treatments often used in joining turbine engine casings and seals.

The low temperature anneal is advantageously 0.5 to 10 hours in length. Most advantageously, the anneal is 0.5 to 6 hours in length. Most advantageously, the low temperature anneal occurs at temperatures of at least 1650° F. (900° C.).

2) Higher temperature beta aging treatments ≧1450° F. (788° C.): Aging temperatures in this range are effective in reducing da/dt rates to $10\times10^{-5}$ in/rain ($4.2\times 10^{-6}$ mm/s), $5\times10^{-5}$ ($2.1\times10^{-6}$ mm/s), or less for all annealing temperatures.

Advantages: 1) When Aging temperatures of ≧1500° F., (816° C.) consistently provides good crack growth resistance regardless of annealing temperature; 2) only way to provide exceptional da/dt resistance for anneals >1850° F. (1010° C.) and <2000° F. (1093° C.); and 3) improves stress rupture ductility.

Disadvantages: 1) May be sensitive to additional instability at 1000° F. (538° C.) due to more abundant beta phase and greater grain boundary beta-matrix interfacial area; 2) creep strength and rapture life sacrificed; (when aging time is not short); and 3) heat treatment not always compatible with heat treatments of other materials in joined engine parts.

The beta aging treatment is advantageously 0.5 to 24 hours in length and most advantageously 1 to 6 hours in length. Most advantageously, the beta aging treatment occurs at a temperature above 820° C. and less than 890° C.

3) High temperature anneal (>2000° F., 1093° C.): With 2050° F. anneal, provides da/dt rates of about $5\times10^{-5}$ in/min ($2.1\times10^{-6}$ mm/s) or less.

Advantages: 1) Solutionizes much beta, including some primary beta, and permits controlled re-precipitation as fine particulates in grain boundaries; 2) slightly coarsens grain size and restores isotropy of grain structure and remaining beta; 3) reduced da/dt dependence on aging heat treatment temperatures; 4) good compromise between stress rupture strength, creep resistance and da/dt resistance is obtainable; and 5) provides optimum impact toughness.

Disadvantages: 1) May result in lower yield strength; and 2) more prone to notched stress rupture fractures if insufficient beta is precipitated.

Advantageously, the high temperature annealing is for 0.5 to 10 hours. Most advantageously, the high temperature annealing is for 0.5 to 6 hours. The high temperature anneal should be at a temperature of less than the melting temperature and most advantageously, less than 2125° F. (1163° C.).

The effect of heat treatments on room temperature tensile yield strength and elongation, and on 649° C./586 MPa combination smooth-notched (Kt3.7) stress rupture life and elongation are further discussed.

A portion of Heat 30 was press-forged and machine lathe-turned to 8" (20 cm) diameter, subsequently hot upset and hot ring-rolled into a gas turbine engine ring measuring 711 mm OD by 610 mm ID by 102 mm high. Specimens for tensile and stress rupture testing were cut from the long transverse (axial) orientation. Smooth gage bar tensile testing was conducted in accordance with ASTM E8 at approximately 24° C. Stress rupture testing was conducted in air under moderate to high humidity (30% to 60% relative humidity) at 649° C. under a nominal net section stress of 586 MPa using a combination smooth-notch (Kt 3.7) bar shaped using a standard low-stress grinding technique. Stress rupture testing and specimens conformed to ASTM E292.

Annealing at 1038° C. and 1121° C. produced material in a relatively soft condition with poor stress rupture life. Water quenching after the anneal resulted in very soft material, and showed that the material age hardens significantly during the slower air cooling. This age hardening was the result of beta and gamma-prime phase precipitation. However, this hardening did not give sufficient tensile or stress rupture strength, although slow furnace cools through the precipitation temperature ranges may produce sufficient strengthening.

The previous studies on the effect of heat treatment on 538° C. da/dt demonstrated that the 1121° C. anneal had significantly improved da/dt resistance (slower crack growth rates) over the 1038° C. anneal. However, when annealing at high temperatures, careful control is necessary to avoid the rapid grain growth that occurs above the beta solvus temperature of about 2070° F. (1130° C.). It appeared that the annealing temperatures between about 1010° C. to about 1090° C. tended not to dissolve sufficient quantities of beta, thus limiting available Al for new beta re-precipitation in a controlled manner using other aging heat treatments. Consequently, the mechanical properties of material annealed in this temperature range tended to vary but slightly with aging heat treatments, and required high temperature aging heat treatments at longer times (>800° C. and >12 h exposure) to get reasonable crack growth resistance.

Thus, the focus of this discussion on mechanical properties is based on the 1121° C. anneal. This high temperature anneal dissolves sufficient quantities of beta and nearly all gamma-prime, spheroidizes and disorders the remaining globular beta while dissolving martensitic phases present, and in the process dissolves Al into the gamma matrix. The additional dissolved Al is then available for re-precipitation during aging heat treatments as either intragranular fine globular (or occasionally acicular) beta, discrete fine intergranular beta, or as gamma-prime, depending on the aging heat treatments employed.

1121° C. Anneal+Isothermal Ages

Isothermal ages between 732° C. and 843° C. after a 1121° C. anneal show varying results.

1. An 8 h isothermal age at 732° C. caused yield strength to increase by 84 MPa to 644 MPa, a useful level of strength. However, stress rupture life and ductility decreased. Aging at this temperature precipitated abundant gamma-prime, but being below the beta precipitation temperature produced no beta. Additionally, the prior-process-precipitated globular beta, showed a decomposition similar to $DO_3$ ordering very similar to that found in $Fe_3Al$, and a small amount of platelet phases formed within the beta globule at the beta-gamma interfaces and in beta-beta grain boundaries. Although not yet positively identified, these platelets appeared to be martensitic BCT based upon $Ni_5Al_3$ or $Ni_2Al$.

Thus, while material with this heat treatment had significantly improved strength, stress rupture life and ductility were worsened by rendering the material more sensitive to oxygen-assisted sustained-load cracking. The classical appearance of a crescent-shaped intergranular fracture regions adjacent to ductile transgranular tensile fracture regions on the notch fracture surface, clearly indicated rapid crack growth due to stress accelerated grain boundary oxygen embrittlement.

Figure 9:
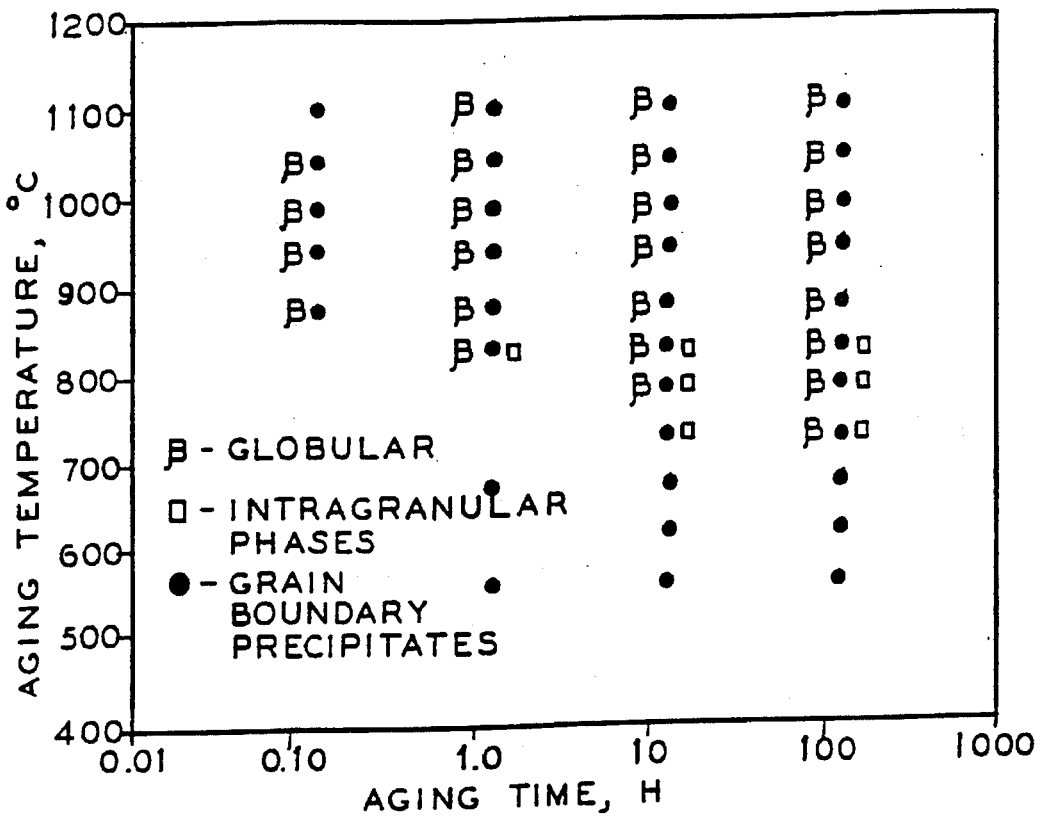
FIG. 9 is a Time-Temperature-Transformation diagram for Heat 30 (Table 3) after solution treatment of 2100° F. (1149° C.) for one hour followed by a water quench.

2. Aging at 788° C. for 16 hours resulted in very good stress rupture life and ductility, and while yield strength did increase (31 MPa), it was below desired levels. This temperature is slightly above the minimum beta precipitation temperature, but still below the gamma-prime solvus illustrated in FIG. 9. Advantageously, gamma prime phase should be precipitated below the gamma prime solvus temperature of about 1500° F. (815° C.). The resulting microstructure thus contained both newly precipitated beta and gamma-prime in addition to prior beta globules. However, the gamma-prime particles are relatively coarse due to the higher precipitation temperature and longer exposure time, and thus the yield strength increase was only moderate. The combination of precipitated beta (which occurred in both grain interiors and grain boundaries) and coarse gamma-prime (resulting in greater micro-creep plasticity) produce both very good rupture life and high ductility by inhibiting environmentally-assisted crack growth. However, the yield strength is inadequate for applications requiring high strength.

3. Aging at 843° C. for 8 h resulted in lower, yet acceptable stress rupture life with excellent ductility, but yield strength decreased to levels even below that of annealed and air cooled material. This temperature is above the gamma-prime solvus, of FIG. 9 and well within the beta precipitation temperature range. Abundant beta was precipitated within grain interiors and boundaries as a result of both gamma-prime to beta transformations and from solid solution as well. Gamma-prime particles not transformed to beta or dissolved, appeared to coarsen in size and obviously became ineffective as tensile strengtheners. The result was acceptable 649° C. rupture life with excellent ductility indicating good resistance to environmental cracking, but with yield strength below that of annealed material and inadequate for applications requiring high strength.

Most advantageously, isothermal aging of 1 to 30 hours follows annealing of 0.5 to 10 hours at temperatures between about 1010° C. and the melting temperature of the alloy. Most advantageously, isothermal anneals are between about 1350° F. and 1500° F. (732° C. and 815° C.). These isothermal ages provide good stress rupture strength and life with some loss in ductility.

1121° C. Anneal+Two-step Aging Heat Treatments

The effect of following the 732° C. and 788° C. aging heat treatments with a 56° C./h furnace cool to 621° C., hold for 8 h, then air cooled, is discussed.

1. 732° C./8 h FC 621° C./8 h AC. The yield strength increased significantly (105 MPa) over the isothermal 732° C. age, due to gamma-prime precipitation strengthening probably aided by the decomposition and transformations within the prior-process beta globules. Gamma-prime in samples with two step heat treatments had a bimodal site distribution believed to enhance tensile strengthening. When using a two step gamma prime aging heat treatment, it is important to furnace cool between aging steps to optimize yield strength. However, the rate of furnace cooling between aging steps was not found to have any measurable effect.

Gamma prime precipitation most advantageously occurs during aging between 950° F. and 1500° F. (510° C. and 815° C.). Coarse gamma prime is most advantageously precipitated at an aging temperature of 1250° F. to 1450° F. (677° C. to 788° C.). Fine gamma prime phase is most advantageously precipitated at a temperature of 1000° F. to 1300° F. (538° C. to 704° C.). Advantageously, the first and second gamma prime aging steps are 0.5 to 12 hours and most advantageously, 1 to 10 hours.

However, gamma-prime precipitation does not contribute to stress accelerated grain boundary oxygen embrittlement, the prior beta precipitation (in volume traction) is inadequate, and therefore stress rupture life is poor owing to environment-sensitive notch fractures. This heat treatment is satisfactory for room temperature applications requiring high strength, but is not useful for elevated temperatures applications.

2. 788° C./16 h FC 621° C./8 h AC. The yield strength again increased greatly (162 MPa) and was nearly identical to that of the 732° C. two-step heat treatment above. In contrast with the 732° C. two-step heat treatment, the stress rupture life and ductility of this material was excellent, indicating significantly improved oxygen embrittlement resistance and good crack growth resistances. Material in this condition showed gamma-prime precipitation with bimodal size distribution in grain interiors accompanied with significant quantities of beta precipitation in grain interiors and a finer beta precipitation within the grain boundaries.

The beneficial effect of combining both optimum quantities of beta phases and gamma-prime of mixed size distribution is seen by the combination of both high strength and good stress rupture life and ductility. This is a beneficial heat treatment for both room temperature and elevated temperature applications, including gas turbine engine usage.

1121° C. Anneal+Three-Step Aging Heat Treatments

This heat treatment combined a higher temperature beta precipitation heat treatment (843° C./2 h AC) with a conventional gamma-prime or gamma-double-prime aging heat treatment such as an aging treatment often used for INCOLOY alloy 909 or INCONEL alloys X750 or 718. Again, high strength and excellent stress rupture life and ductility are attained. In fact, even higher yield strength was attained over two-step aging heat treatments.

The microstructure of this material had relatively coarse gamma grains (ranging from ASTM #5 to #1) containing cuboidal gamma-prime of bimodally distributed sizes. Within grain interiors both beta globules formed during prior processing and newly precipitated beta particles (which may appear acicular) were found. The coarser beta globules and particles showed an ordered or partially ordered $DO_3$ phase similar to that of $Fe_3Al$ and platelet phases within the beta globules at beta-matrix interfaces and at beta-beta grain boundaries (coarse prior-precipitated beta globules were often found interconnected by grain boundaries).

The three-step heat treatment utilizing the short time, higher temperature beta precipitation heat treatment allowed the reduction of the total aging heat treatment time from about 27 hours for the 788° C./16 FC 55° C./h to 621° C./8 h AC heat treatment to about 20 hours or even less. Additionally, the short time beta precipitation heat treatment permits flexibility with the gamma-prime aging heat treatments so that the alloy can be conveniently heat treated when joined to dissimilar superalloys such as INCONEL alloy 706 or 718. Furthermore, this alloy may be chromized or joined to ceramics such as silicon nitride. Table 16 below summarizes mechanical testing data from the above heat treatments.

TABLE 16

Effect of Heat Treatment on Room Temperature Tensile (RTT) and 649° C.// 586 MPa Combination Smooth-Notched (Kt 3.7) Stress Rupture (SRU) Properties Heat #30 Hot Rolled Engine Rings

| Heat Treatment (°C.) | RTT YS (MPa) | RTT EL, (%) | SRU Life, (h) | SRU El (%) |
|---|---|---|---|---|
| Anneal & Cooling, Unaged | | | | |
| 1038/1 h, WO | 331 | 44 | 11.5 | 17 |
| 1038/1 h, A | 545 | 35 | 14.0 | 9 |
| 1121/1 h, AC | 560 | 38 | NT | NT |
| High Temperature Anneal, Air Cool + Isothermal Aging Heat Treatments | | | | |
| 1121/1 h, AC + 732/8 h, AC | 644 | 31 | 2.1 | Notch |
| 1121/1 h, AC + 788/16 h, AC | 591 | 29 | 60.7 | 34 |
| 1121/1 h, AC + 843/8 h, AC | 505 | 34 | 34.7 | 34 |
| High Temperature Anneal, Air Cool + Two-Step Aging Heat Treatments | | | | |
| 1121/1 h, AC + 732/8 h, FC 621/8 h, AC | 749 | 27 | 10.1 | Notch |
| 1121/1 h, AC + 788/16 h, FC 621/8 h, AC | 753 | 23 | 52.4 | 16 |
| High Temperature Anneal, Air Cool + Three-Step Aging Heat Treatment | | | | |
| 1121/1 h, AC + 843/2 h, AC + 718/8 h, FC 621/8 h, AC | 780 | 24 | 54.3 | 26 |

Notes:
1) AC = Air Cooled to room temperature
WQ = Water Quenched to room temperature
FC = Furnace Cooled 56° C./h to temperature shown
2) NT = Not tested
3) YS = 0.2% Offset Yield Strength, EL = Elongation
4) Notch = Fractured in notched section at life hours shown

TABLE 17

| HEAT | Fe | Ni | Co | Al | Ti | Nb | Cr |
|---|---|---|---|---|---|---|---|
| 1 | 25.6 | 28.9 | 34.0 | 5.4 | 0.0 | 3.0 | 3.2 |
| 2 | 25.8 | 28.6 | 34.2 | 5.2 | 0.1 | 3.1 | 3.1 |
| 3 | 25.4 | 28.4 | 34.1 | 5.5 | 0.2 | 3.0 | 3.3 |
| 4 | 25.7 | 28.2 | 34.2 | 5.4 | 0.3 | 3.0 | 3.1 |
| 5 | 25.9 | 28.3 | 34.3 | 5.0 | 0.4 | 3.0 | 3.1 |

TABLE 17-continued

| HEAT | Fe | Ni | Co | Al | Ti | Nb | Cr |
|---|---|---|---|---|---|---|---|
| 6 | 25.0 | 27.4 | 33.3 | 5.2 | 0.5 | 3.0 | 5.5 |
| 7 | 25.9 | 27.9 | 34.1 | 5.3 | 0.0 | 4.1 | 3.0 |
| 8 | 25.9 | 27.3 | 34.3 | 5.6 | 0.2 | 3.8 | 3.2 |

Approximately, 0.007% was added to each heat.

The compositions of Table 17 were tested for the effects of long term exposure to stability with respect to varied titanium contents.

Figure 10:
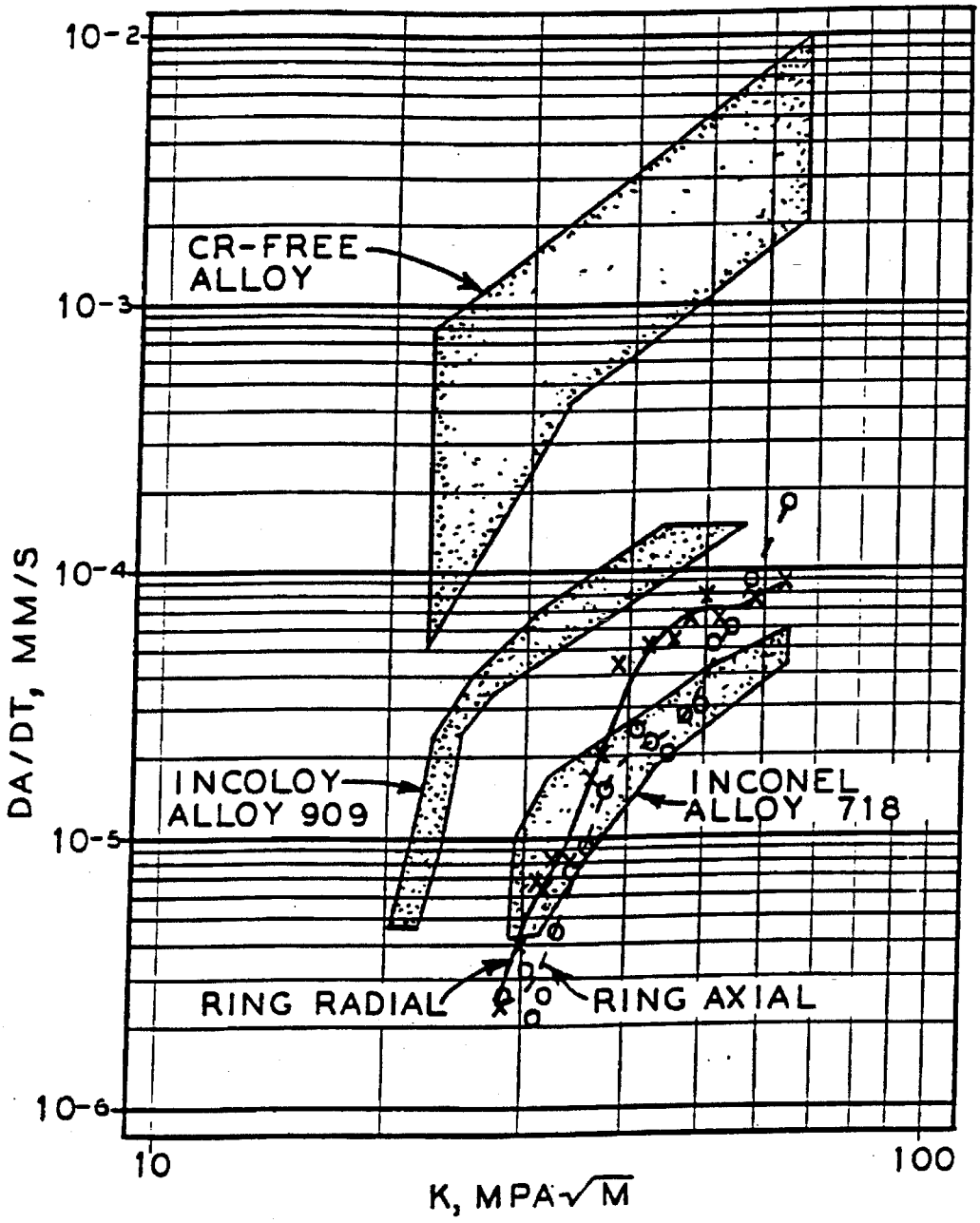
FIG. 10 is a complete da/dt crack growth curve at 538° C. for Heat 30 (Table 3) tested in the short and long transverse orientations in comparison to alloys 718, 909 and similar alloys without chromium.

The alloy of FIG. 10 was given a 1 hour anneal at 1121° C., air cooled, a beta precipitation age at 843° C. for 1 hour, air cooled, aged with a two step gamma prime aging treatment of 732° C. for 1 hour, furnace cooled to 641° C. held, for 1 hour and air cooled. There may be some orientation effect on da/dt, but the two curves are within da/dt testing precision and are not significantly different. These data illustrate one method wherein annealing and aging heat treatment effects are combined to achieve a desired set of useful and practical properties.

TABLE 18

Ti SENSITIVITY STUDY EFFECT OF 1000 HOUR EXPOSURES ON RTT DUCTILITY

| | Baseline Heat Treat. | | + 482° C./ 1000 h, AC | | + 538° C./ 1000 h, AC | | + 649° C./ 1000 h, AC | | + 704° C./ 1000 h, AC | |
|---|---|---|---|---|---|---|---|---|---|---|
| HEAT | El % | RA % | El % | Ra % | El % | Ra % | El % | Ra % | El % | RA % |
| 1 | 24.3 | 43.7 | 22.9 | 37.7 | 20.0 | 33.6 | 22.9 | 40.8 | 21.4 | 34.9 |
| 2 | 25.0 | 36.5 | 25.0 | 35.5 | 23.6 | 35.3 | 20.7 | 42.5 | 20.7 | 29.8 |
| 3 | 22.9 | 41.4 | 18.6 | 25.4 | 18.6 | 36.7 | 22.9 | 39.1 | 21.4 | 40.3 |
| 4 | 22.9 | 41.0 | 20.0 | 32.9 | 20.0 | 36.3 | 21.4 | 43.1 | 20.0 | 34.9 |
| 5 | 25.0 | 37.6 | 25.7 | 23.9 | 24.3 | 37.3 | 24.0 | 41.0 | 20.0 | 22.0 |
| 6 | 25.0 | 44.6 | 25.7 | 41.1 | 22.9 | 41.9 | 23.6 | 44.3 | 9.3 | 10.9 |
| 7 | 22.9 | 42.4 | 20.0 | 23.7 | 22.9 | 42.4 | 20.0 | 41.1 | 20.0 | 37.6 |
| 8 | 20.0 | 36.5 | 7.1 | 7.6 | 15.7 | 29.0 | 18.6 | 35.7 | 12.1 | 11.6 |

TABLE 19

EFFECT OF 1000 HOUR EXPOSURES ON RTT STRENGTH (MPa)

| | Baseline Heat Treat. | | + 482° C./ 1000 h, AC | | + 538° C./ 1000 h, AC | | + 649° C./ 1000 h, AC | | + 704° C./ 1000 h, AC | |
|---|---|---|---|---|---|---|---|---|---|---|
| HEAT | YS | TS | YS | TS | YS | TS | YS | TS | YS | TS |
| 1 | 762 | 1211 | 782 | 1222 | 855 | 1276 | 774 | 1213 | 735 | 1152 |
| 2 | 704 | 1144 | 776 | 1153 | 793 | 1194 | 838 | 1268 | 679 | 1116 |
| 3 | 832 | 1271 | 909 | 1315 | 943 | 1356 | 720 | 1145 | 753 | 1196 |
| 4 | 829 | 1265 | 887 | 1296 | 927 | 1333 | 818 | 1245 | 758 | 1192 |
| 5 | 721 | 1140 | 613 | 1134 | 796 | 1185 | 759 | 1160 | 690 | 1105 |
| 6 | 825 | 1265 | 876 | 1285 | 918 | 1342 | 845 | 1278 | 632 | 1045 |
| 7 | 835 | 1251 | 876 | 1322 | 835 | 1272 | 863 | 1269 | 768 | 1217 |
| 8 | 916 | 1340 | 945 | 1365 | 1025 | 1446 | 908 | 1330 | 922 | 1362 |

Baseline heat treatment:
1121° C./1 h, AC + 843° C./2 h, AC + 718° C./8 h FC (38° C./h) to 621° C./8 h, AC Referring to Table 18, it appeared that the alloys gained a small amount of strength without a significant loss in ductility after 538° C. exposure. Strength was constant after exposure to 649° C. and slightly decreased after exposure to 704° C. However, it was also noted that alloy 6 with 5.5% Cr and 0.5% Ti showed some embrittlement after exposure to 704° C. for 1,000 hours. Thus, from the above data, it was confirmed that it is most advantageous to limit titanium to less than about 0.5 wt %.

Referring to FIG. 10, da/dt of Heat 30 in this heat treated condition is an order of magnitude improved over 909, two orders or more over similar alloys without chromium, and at stress intensities less than about 45 ksi√in (49.5 MPa√m) is equivalent to that of 718.

Alloys of the invention are expected to be suitable for most casting applications. Similar alloys have demonstrated some acceptable castability properties. Also, beta phase formation appears to provide good weldability for a high Al-containing alloy. (Typical high Al superalloys are difficult to weld.) Alloys of the invention may also be formed by powder metallurgy, mechanical alloying with oxide dispersoids such as yttria or by thermal spray deposition.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method of heat treating an alloy consisting essentially of, by weight percent, about 26–50% cobalt, about 20–40% nickel, about 20–35% iron, about 4– 10% aluminum, about 0.5–5% total niobium plus ½ of tantalum weight percent, about 1.5–10% chromium, about 0–1% titanium, about 0–0.2% carbon, about 0–1% copper, about 0–2% manganese, about 0–2% silicon, about 0–8% molybdenum, about 0–8% tungsten, about 0–0.3% boron, about 0–2% hafnium, about 0–2% rhenium, about 0–0.3% zirconium, about 0–0.5% nitrogen, about 0–1% yttrium, about 0–1% lanthanum, about 0– 1% total rare earths other than lanthanum, about 0–1% cerium, about 0–1% magnesium, about 0–1% calcium, about 0–4% oxidic dispersoid and incidental impurities, comprising the steps of:

annealing at a temperature between at least about 1066° C. and below the melting temperature of the alloy, and aging at a temperature less than about 815° C. for gamma prime precipitation.

2. The heat treatment of claim 1 wherein said annealing solutionizes beta phase and increases isotropic behavior of the alloy.

3. The heat treatment of claim 2 wherein said annealing temperature is at least about 1110° C. for solutionizing sufficient beta phase for subsequent grain boundary precipitation of beta phase.

4. The heat treatment of claim 1 including the step of aging at a temperature greater than about 788° C. for beta phase precipitation.

5. The heat treatment of claim 4 wherein the aging temperature is less than about 890° C.

6. The method of claim 4 wherein said aging for gamma prime precipitation includes an age at a first temperature for precipitation of coarse gamma prime phase and an age at a second lower temperature for precipitation of fine gamma prime phase with furnace cooling between the gamma prime aging steps.

7. The method of claim 6 wherein said anneal is for 0.5 to 10 hours, said beta aging treatment is for 0.5 to 24 hours and each gamma prime aging step in from 0.5 to 12 hours.

8. The method of claim 6 wherein the alloy has a composition of: about 30– 38% cobalt, about 26–33 nickel, about 24–28% iron, about 4.8–6.0% aluminum, about 2–3.5% total niobium plus ½ of tantalum weight percent, about 2–4% chromium, about 0–0.2% titanium, about 0–0.05% carbon, about 0–0.5% copper, about 0.5% manganese, about 0.5% silicon, total copper plus manganese plus silicon being less than about 1%, about 0–3% molybdenum, about 0–3% tungsten, total molybdenum plus tungsten being less than about 5%, about 0–0.015% boron, about 0–0.5% hafnium, about 0–0.5% rhenium, about 0–0.1% zirconium, about 0–0.2% nitrogen, about 0–0.2% yttrium, about 0–0.2% lanthanum, about 0–0.2% total rare earths other than lanthanum, about 0–0.2% cerium, about 0–0.2% magnesium, about 0–0.2% calcium, about 0–2% oxidic dispersoid and incidental impurities.

9. A method of heat treating an alloy consisting essentially of, by weight percent, about 26–50% cobalt, about 20–40% nickel, about 20–35% iron, about 4–10% aluminum, about 0.5–5% total niobium plus ½ of tantalum weight percent, about 1.5– 10% chromium, about 0–1% titanium, about 0–0.2% carbon, about 0–1% copper, about 0–2% manganese, about 0–2% silicon, about 0–8% molybdenum, about 0–8% tungsten, about 0–0.3% boron, about 0–2% hafnium, about 0–2% rhenium, about 0–0.3% zirconium, about 0–0.5% nitrogen, about 0–1% yttrium, about 0–1% lanthanum, about 0–1% total rare earths other than lanthanum, about 0–1% cerium, about 0–1% magnesium, about 0–1% calcium, about 0–4% oxidic dispersoid and incidental impurities, comprising the steps of:

aging at a temperature of about 788° C. to 890° C. for beta phase precipitation; and aging at a temperature less than about 815° C. for gamma prime precipitation.

10. The heat treatment of claim 9 wherein the alloy is annealed at a temperature of at least about 1066° C. and the melting temperature for solutionizing beta phase and increasing isotropic behavior of the alloy prior to said aging.

11. The heat treatment of claim 10 wherein said annealing temperature is at least about 1110° C. for solutionizing sufficient beta phase for subsequent grain boundary precipitation of beta phase.

12. The heat treatment it of claim 9 wherein said beta precipitation aging temperature at least about 820° C.

13. The method of claim 9 wherein the alloy is aged for gamma prime precipitation at a first temperature for precipitation of coarse gamma prime phase and at a second lower temperature for precipitation of fine gamma prime phase after said beta aging step with furnace cooling between the gamma prime aging steps.

14. The method of claim 13 wherein the alloy has a composition of: about 30– 38% cobalt, about 26–33 nickel, about 24–28% iron, about 4.8–6.0% aluminum, about 2–3.5% total niobium plus ½ of tantalum weight percent, about 2–4% chromium, about 0–0.2% titanium, about 0–0.05% carbon, about 0–0.5% copper, about 0.5% manganese, about 0.5% silicon, total copper plus manganese plus silicon being less than about 1%, about 0–3% molybdenum, about 0–3% tungsten, total molybdenum plus tungsten being less than about 5%, about 0–0.015% boron, about 0–0.5% hafnium, about 0–0.5% rhenium, about 0–0.1% zirconium, about 0–0.2% nitrogen, about 0–0.2% yttrium, about 0–0.2% lanthanum, about 0–0.2% total rare earths other than lanthanum, about 0–0.2% cerium, about 0–0.2% magnesium, about 0–0.2% calcium, about 0–2% oxidic dispersoid and incidental impurities.

15. The method of claim 14 wherein said annealing treatment is for 0.5 to 6 hours, said beta precipitation treatment is for 1 to 6 hours and each of said gamma prime aging treatments are 1 to 10 hours.

16. A method of heat treating an alloy consisting essentially of, by weight percent, about 26–50% cobalt, about 20–40% nickel, about 20–35% iron, about 4–10% aluminum, about 0.5–5% total niobium plus ½ of tantalum weight percent, about 1.5– 10% chromium, about 0–1% titanium, about 0–0.2% carbon, about 0–1% copper, about 0–2% manganese, about 0–2% silicon, about 0–8% molybdenum, about 0–8% tungsten, about 0–0.3% boron, about 0–2% hafnium, about 0–2% rhenium, about 0–0.3% zirconium, about 0–0.5% nitrogen, about 0–1% yttrium, about 0–1% lanthanum, about 0–1% total rare earths other than lanthanum, about 0–1% cerium, about 0–1% magnesium, about 0–1% calcium, about 0–4% oxidic dispersoid and incidental impurities, comprising the steps of:

annealing at a temperature between at least about 1010° C. and below the melting temperature of the alloy, and isothermally aging for 1 to 30 hours at a temperature between about 732° C. and 815° C. for beta and gamma prime precipitation.

17. A method of heat treating an alloy consisting essentially of, by weight percent, about 26–50% cobalt, about 20–40% nickel, about 20–35% iron, about 4–10% aluminum, about 0.5–5% total niobium plus ½ of tantalum weight percent, about 1.5– 10% chromium, about 0–1% titanium, about 0–0.2% carbon, about 0–1% copper, about 0– 2% manganese, about 0–2% silicon, about 0–8% molybdenum, about 0–8% tungsten, about 0–0.3% boron, about 0–2% hafnium, about 0–2% rhenium, about 0–0.3% zirconium, about 0–0.5% nitrogen, about 0–1% yttrium, about 0–1% lanthanum, about 0–1% total rare earths other than lanthanum, about 0–1% cerium, about 0–1% magnesium, about 0–1% calcium, about 0–4% oxidic dispersoid and incidental impurities, comprising the steps of:

annealing at a temperature of below about 1010° C., and aging at a temperature less than about 815° C. for gamma prime precipitation.

18. The heat treatment of claim 17 including the step of aging at a temperature greater than about 788° C. for beta phase precipitation.

19. The heat treatment of claim 18 wherein the aging temperature is less than about 890° C.

20. The method of claim 18 wherein said aging for gamma prime precipitation includes an age at a first temperature for precipitation of coarse gamma prime phase and an age at a second lower temperature for precipitation of fine gamma prime phase with furnace cooling between the gamma prime aging steps.

21. The method of claim 20 wherein said anneal is for 0.5 to 10 hours, said beta aging treatment is for 0.5 to 24 hours and each gamma prime aging step in from 0.5 to 12 hours.

22. The method of claim 20 wherein the alloy has a composition of: about 30–38% cobalt, about 26–33 nickel, about 24–28% iron, about 4.8–6.0% aluminum, about 2–3.5% total niobium plus ½ of tantalum weight percent, about 2–4% chromium, about 0–0.2% titanium, about 0–0.05% carbon, about 0–0.5% copper, about 0.5% manganese, about 0.5% silicon, total copper plus manganese plus silicon being less than about 1%, about 0–3% molybdenum, about 0–3% tungsten, total molybdenum plus tungsten being less than about 5%, about 0–0.015% boron, about 0–0.5% hafnium, about 0–0.5% rhenium, about 0–0.1% zirconium, about 0–0.2% nitrogen, about 0–0.2% yttrium, about 0–0.2% lanthanum, about 0–0.2% total rare earths other than lanthanum, about 0–0.2% cerium, about 0–0.2% magnesium, about 0–0.2% calcium, about 0–2% oxidic dispersoid and incidental impurities.

* * * * *

UNITED STATES PATENT AND TRADEMARK OFFICE

CERTIFICATE OF CORRECTION

PATENT NO. : 5,478,417
DATED : December 26, 1995
INVENTOR(S) : Karl Andrew Heck, et. al.

It is certified that error appears in the above-indentified patent and that said Letters Patent is hereby corrected as shown below:

Cover Page, after [73] Assignee: for "Goro Nickel S.A., Caledonie" read --Inco Alloys International, Inc., Huntington, W. Va.--
Cover Page, in the ABSTRACT, line 16, after "at" read --a--.
Column 4, line 4, for "mount" read --amount--.
Column 4, line 48, for "0.9" read --0.8--.
Column 5, line 15, for "4-9" read --4-8--.
Column 6, line 26 (Table 3, under "Co", row 5), "34.1" read --32.0--.
Column 6, line 28 (Table 3, under "Ti", row 7), "0.14" read --0.13--.
Column 6, line 28 (Table 3, under "Co", row 7), "31.0" read --33.1--.
Column 7, line 27, for "15126" read --15/26--.
Column 9, line 29, for "tier" read --for--.
Column 10, line 63 and column 11, line 1, for "mounts" read --amounts--.
Column 11, line 50, for "an alloy" read --alloys--.
Column 14, line 22, for "Co" read --30Co--.
Column 18, line 21, for "minute" read --inches/minute--.
Column 18, line 21, after "$2.1 \times 10^{-6}$" delete "inches".
Column 18, line 59, for "rapture" read --rupture--.
Column 22, line 28, for "A" read --AC--.

Signed and Sealed this

Twenty-ninth Day of July, 1997

Bruce Lehman

*Attest:*

BRUCE LEHMAN

*Attesting Officer*

*Commissioner of Patents and Trademarks*